US010477961B2

(12) United States Patent
Heim et al.

(10) Patent No.: US 10,477,961 B2
(45) Date of Patent: Nov. 19, 2019

(54) FOLDING TABLE

(71) Applicant: LEKISPORT AG, Baar (CH)

(72) Inventors: Eberhard Heim, Unterensingen (DE); Tobias Böing, Grossbettlingen (DE); Christoph Doll, Kirchheim (DE)

(73) Assignee: LEKISPORT AG, Baar (CH)

( * ) Notice: Subject to any disclaimer, the term of this patent is extended or adjusted under 35 U.S.C. 154(b) by 0 days.

(21) Appl. No.: 16/096,353

(22) PCT Filed: Apr. 5, 2017

(86) PCT No.: PCT/EP2017/058124

§ 371 (c)(1),
(2) Date: Oct. 25, 2018

(87) PCT Pub. No.: WO2017/190909

PCT Pub. Date: Nov. 9, 2017

(65) Prior Publication Data

US 2019/0125071 A1 May 2, 2019

(30) Foreign Application Priority Data

May 6, 2016 (CH) ..... 0597/16
Dec. 7, 2016 (CH) ..... 1609/16

(51) Int. Cl.
*A47B 3/12* (2006.01)
*A47B 3/00* (2006.01)
(Continued)

(52) U.S. Cl.
CPC ..... *A47B 3/12* (2013.01); *A47B 3/002* (2013.01); *A47B 3/06* (2013.01); *A47B 13/003* (2013.01);
(Continued)

(58) Field of Classification Search
CPC .. A47B 3/12; A47B 3/06; A47B 3/002; A47B 13/02; A47B 13/088
See application file for complete search history.

(56) References Cited

U.S. PATENT DOCUMENTS 1,608,924 A * 11/1926 Brown ..... A47B 3/02 108/118
4,210,085 A * 7/1980 McLravy, II ..... A47B 3/02 108/118
(Continued)

FOREIGN PATENT DOCUMENTS

DE 8902765.5 U1 11/1989
EP 0 105 957 A1 4/1984
(Continued)

OTHER PUBLICATIONS

International Search Report for PCT/EP2017/058124 dated May 4, 2017 [PCT/ISA/210].

*Primary Examiner* — Daniel J Rohrhoff
(74) *Attorney, Agent, or Firm* — Sughrue Mion, PLLC

(57) ABSTRACT

A portable table (1), comprising a table top (11) and a frame (1*a*) having two front legs (2, 3) and two rear legs (4, 5) as well as two front arms (6, 7) and two rear arms (8, 9). The front arms and front legs are fastened on a first, front connecting element (12), and the rear arms and rear legs are fastened on a second, rear connecting element (13). The first, front connecting element is connected to the second, rear connecting element by at least one first connecting rod (14). Coupling elements connecting the arms to in each case one first or second longitudinal rod (54, 55), are arranged on the upper ends of the arms. The table top comprises at least one device (65*a*, 65*b*, 66*a*, 66*b*) by means of which the table top is releasably fastenable on the frame.

27 Claims, 9 Drawing Sheets

(51) Int. Cl.

| | |
|---|---|
| ***A47B 3/06*** | (2006.01) |
| ***A47B 13/00*** | (2006.01) |
| ***A47B 13/08*** | (2006.01) |
| ***A47B 13/02*** | (2006.01) |

(52) U.S. Cl.
CPC ..... *A47B 13/02* (2013.01); *A47B 13/088* (2013.01); *A47B 2013/006* (2013.01); *A47B 2220/008* (2013.01); *A47B 2220/09* (2013.01)

(56) References Cited

U.S. PATENT DOCUMENTS

| | | | | |
|---|---|---|---|---|
| 6,234,089 | B1 * | 5/2001 | Zheng | A47B 3/002 108/115 |
| 6,367,393 | B1 * | 4/2002 | Kasten | A47B 3/12 108/153.1 |
| 2010/0282133 | A1 * | 11/2010 | Wong | B23K 37/0461 108/50.11 |
| 2014/0083337 | A1 * | 3/2014 | Isgro | A47B 13/088 108/64 |
| 2016/0296004 | A1 * | 10/2016 | Peng | A47B 3/002 |
| 2017/0100834 | A1 * | 4/2017 | Luis y Prado | B25H 1/04 |
| 2017/0311723 | A1 * | 11/2017 | Lenhart | A47C 4/286 |
| 2018/0310706 | A1 * | 11/2018 | Wheeler | A47J 37/0772 |

FOREIGN PATENT DOCUMENTS

| | | | | |
|---|---|---|---|---|
| EP | 1120062 | A1 * | 8/2001 | A47B 13/02 |
| EP | 2941983 | A1 * | 11/2015 | A47B 3/02 |
| WO | 2016/055280 | A1 | 4/2016 | |
| WO | WO-2018043938 | A1 * | 3/2018 | A47B 3/06 |

* cited by examiner

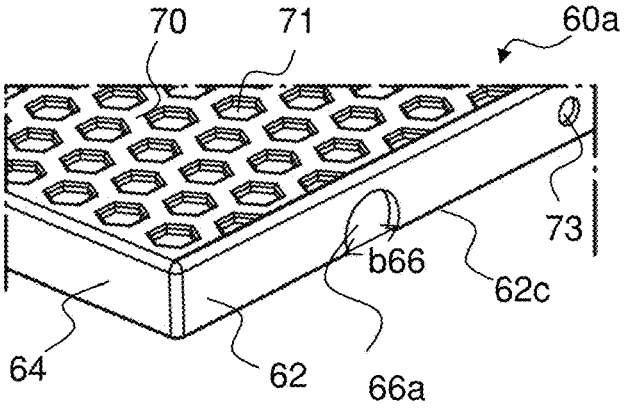
FIG. 4
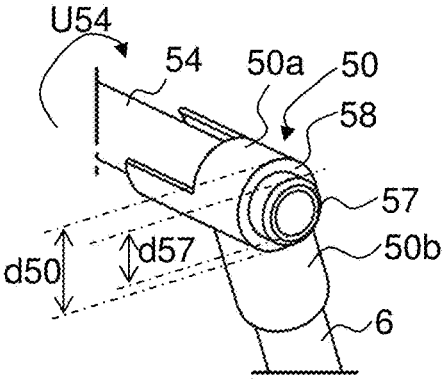
FIG. 5
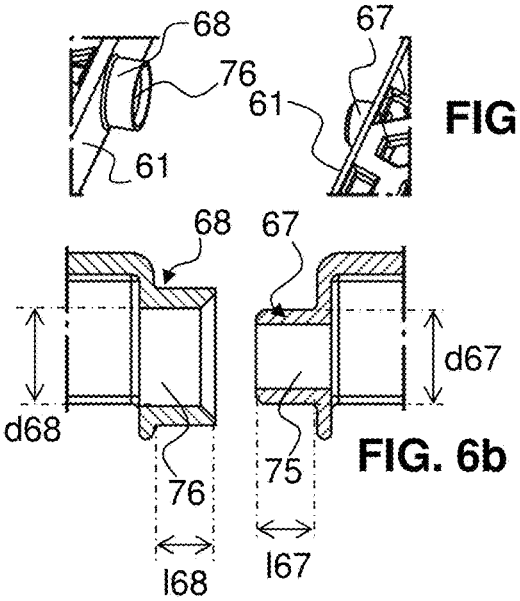
FIG. 6a
FIG. 6b
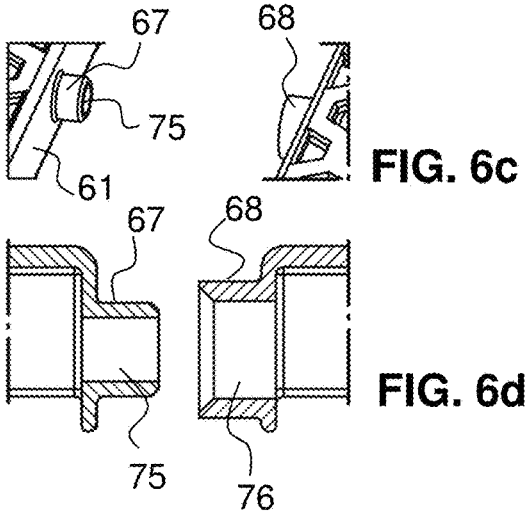
FIG. 6c
FIG. 6d

FOLDING TABLE

CROSS REFERENCE TO RELATED APPLICATIONS

This application is a National Stage of International Application No. PCT/EP2017/058124 filed Apr. 5, 2017, claiming priority based on Switzerland Patent Application Nos. 00597/16 filed May 6, 2016 and 01609/16 filed Dec. 7, 2016.

TECHNICAL SCOPE

The present invention relates to a portable, foldable table, in particular for outdoor use, e.g. for camping, mountain tours, etc.

PRIOR ART

Lightweight items of furniture, in particular foldable chairs, tables and beds, are very popular for the outdoors. For example, U.S. Pat. No. 1,608,924 discloses a folding table, over the collapsible frame of which a textile table top can be stretched, the table legs being fastened by way of hinges. The load capacity and stability of the textile table top, however, is insufficient in particular for heavier objects, such as beverage bottles, etc. In the case of the camping table proposed in DE 8902765.5, the table top consists of wooden panels held by way of brackets, however the stability of the table here is insufficient on account of the individually fastened legs.

REPRESENTATION OF THE INVENTION

The object underlying the present invention is to provide an improved folding table which comprises a high level of inner stability and is also suitable to be loaded with heavier objects, e.g. beverage bottles. On the one hand, the table is to be simple to produce, but also simple to erect and to collapse. In addition, the table is to pack down as small as possible.

Said object is achieved by a table according to Claim 1.

The invention consequently relates to a portable table, comprising a table top and a substructure or rather a frame, wherein the frame comprises two front legs and two rear legs as well as two front arms and two rear arms. The front legs and the rear legs comprise in each case a first, lower, free end which is directed toward a support on which the table stands. The front arms and rear arms comprise in each case a second, upper, initially free end which is directed toward the table top. The front legs, by way of their second, upper end, which is located opposite the first, lower free end, and the front arms, by way of their first, lower end which is located opposite the second, upper end, are fastened on and/or in a first, front connecting element. The rear legs, by way of their second upper end, which is located opposite the first, lower, free end and the rear arms, by way of their first, lower end, which is located opposite the second, upper end, are also fastened on and/or in a second, rear connecting element. The first, front connecting element is connected, in this case, to the second, rear connecting element by means of at least one first connecting rod. The disclosure of WO 2016/055280 A1 is also expressly included in the disclosure of this application with regard to the design of the connecting elements and of the connecting rods.

A first, front, left coupling element, which connects the front, left arm to a first or rather left longitudinal rod, which is arranged parallel to the at least one first connecting rod, is arranged on the second, upper end of the front, left arm. A second, rear, left coupling element, which connects the rear, left arm to the first or rather left longitudinal rod, is arranged on the second, upper end of the rear, left arm.

A third, front, right coupling element, which connects the front, right arm to a second or rather right longitudinal rod, which is arranged parallel to the at least one first connecting rod and opposite the first, left longitudinal rod, is arranged on the second, upper end of the front, right arm. A fourth, rear, right coupling element, which connects the rear, right arm the second or rather right longitudinal rod, is arranged on the second, upper end of the rear, right arm. According to the invention, the table top comprises at least one device by means of which the table top is releasably fastenable on the frame.

Said device can be, for example, a recess or a device which is integrally moulded in one piece on the table top or a device which is fastened releasably or fixedly on the table top, by means of which device the table top is able to be releasably connected to the frame, such as, for example, a clamping or plug-in connection or a latching connection.

The table top is preferably releasably fastenable on the first longitudinal rod and/or on the second longitudinal rod by means of the at least one device when setting up the portable table or rather is releasably fastened thereon in the assembled state.

As an alternative to this or in addition to it, it is possible for the table top to be releasably fastenable to at least one of the four coupling elements.

In a preferred embodiment, the table top is releasably fastenable on the two longitudinal rods and additionally on at least one of the four coupling elements, preferably on at least two of the four coupling elements, and in a particularly preferred manner on all four coupling elements.

In this case, in the case of a preferred portable table or rather folding table, the table top or at least regions thereof are connected in a positive locking and/or non-positive locking manner to the frame by means of the at least one device. It can be advantageous in this case when, for assembly, the table top is initially just placed onto the two longitudinal rods, for example by means of recesses provided for this purpose on the underside of the table top, and then is fastened, e.g. snapped or rather clamped, or clipped at, e.g., four points, each with a device, on the four coupling elements. As an alternative to this, the table top could, however, also be clipped onto the two longitudinal rods and only be placed onto the coupling elements, for example by means of gaps provided for this purpose on the underside of the table top. The table top can also be snapped or rather clamped onto both the longitudinal rods and coupling elements. In the case of a variant of the table top which is covered by a material layer, the at least one device for fastening the table top on the frame could be designed in the form of four pockets which are sewn on the four corners of the table top, and serve for the purpose of pulling the table top over the four coupling elements.

The table top is preferably composed of individual table elements which are couplable together, preferably in the form of plate elements or profile elements or, for example, lamellae, which comprise in each case at least one open recess, which is directed down toward the support, for the positive locking and or non-positive locking connection to the frame, in particular for support and/or connection to the first and the second longitudinal rod. The table element preferably comprises four side faces, preferably one side face of the respective table element, in a particularly preferred manner two oppositely situated side faces of the respective table element, comprising one such downwardly directed recess. According to a preferred exemplary embodiment, the table top is formed from 4-10, preferably from 6-8 table elements which are coupled together.

It is particularly advantageous when the table top is composed of individual table elements which are couplable together or are coupled together. This can be designed, for example, in the form of a roller plate or in the form of individual plate elements which are fastened together in a releasable or fixed manner. The individual table elements preferably comprise in each case a rectangular base surface. The longitudinal axis of said rectangular table elements is advantageously arranged transversely with respect to a longitudinal axis of the at least one first connecting rod of the frame and consequently also transversely with respect to a longitudinal axis of the two longitudinal rods. This provides particularly good stability when the table top is loaded with objects as the table elements rest on the longitudinal rods with their own longitudinal axes transversely to the longitudinal axis of the longitudinal rods. The individual table elements, which are couplable together, comprise, according to a particularly preferred embodiment, in each case a base surface which forms a top surface of the table top. The base surface is delimited by four side faces which extend substantially at right angles to the base surface, preferably toward the support or the frame. Such a table element can be designed as a substantially solid plate, or however, for the purpose of weight reduction, can be realized to some extent as a hollow profile plate, preferably without any base area located opposite the base surface. Such a profile plate preferably comprises a U-shaped cross section which is downwardly open, i.e. toward the support (section plane transversely to the longitudinal direction of a table element). The first side face, which extends in the longitudinal direction of the table element, and the second side face, which extends in the longitudinal direction of the table element and is located opposite the first side face in the longitudinal direction of the longitudinal rod, form, in this case, the two legs of the U-shaped profile when viewed in cross section transversely to the longitudinal direction of the table element.

According to a particularly preferred embodiment, all the table elements forming the table top are realized in an identical manner. In this case, the frontmost and the rearmost table elements do not comprise any additional device that the table elements arranged between the frontmost and the rearmost table element do not comprise. It is preferred, in this case, for either the frontmost table element or the rearmost table element to be arranged in a reverse orientation, i.e. rotated by 180 degrees in the circumferential direction of the folding table, with reference to the remaining table elements forming the table top. This means, for example, that the side face, which is directed rearward in the case of the remaining table elements, is directed forward in the case of the frontmost table element or in the case of the rearmost table element.

The first and the second side faces preferably comprise in each case a downwardly open recess for supporting and engaging the table element on at least one longitudinal rod. The first and the second side faces preferably comprise in each case two recesses, which are spaced apart from one another along the longitudinal axis of the table element for supporting and engaging on the first and on the second longitudinal rod. Depending on the width of the recess on the lower edge of the side face, the respective table element is able to be placed and/or clamped onto the longitudinal rod.

At least the frontmost and the rearmost table elements preferably comprise, on their second side face, which extends in the longitudinal direction, in each case, at least one downwardly open recess for clamping the frontmost table element and the rearmost table element on, in each case, two of the four coupling elements. Said recess, according to a preferred exemplary embodiment, is the same as those of the remaining table elements forming the table top, only the outside diameter of the projection of the coupling elements, on which the table element is clamped, is greater than the outside diameter of the longitudinal rods, such that the relevant frontmost and rearmost table elements can only be fitted or rather clipped/clamped/snapped in a latching manner onto the coupling elements by overcoming a force, whilst the table elements arranged between the frontmost and the rearmost table elements only rest in a relatively loose manner on the longitudinal rods in order to prevent displacement of the table top relative to the frame in a direction along the longitudinal axis of the individual table elements. However, it is also possible for the recesses of the table elements located in between to comprise recesses such that the relevant table element can only be fitted or rather clipped/clamped/snapped in a latching manner onto the longitudinal rods by overcoming a force.

As a result of the non-positive locking connection between the table top on the four coupling elements and, where applicable, the longitudinal rods, the table top remains connected to the frame, even if the folding table is lifted up, for example to change its position. It is additionally possible by varying the diameter of the longitudinal rods or rather of the recesses on the table elements, to clip all or individual table elements onto the longitudinal rods.

According to a further embodiment of the present invention, spacers are arranged between the individual table elements which are couplable together and form the table top.

The respective first side face of a table element, which extends in the longitudinal direction of the table element at right angles from a base surface forming a portion of a table surface, preferably comprises in each case at least one spacer which is directed to the respective adjacent table element. In the case of a further preferred embodiment of a folding table, each table element comprises, on the first side face, two spacers which are spaced apart from one another in the longitudinal direction of the table element. Said spacers comprise different outside diameters. The spacers are preferably only arranged on the first side face, whilst the second side face, which comprises the recesses for clamping onto the coupling elements, is free of spacers.

It is particularly advantageous when the spacers are realized so as to be complementary to one another or rather are insertable into one another. For this purpose, the second spacer comprises a passage opening which is arranged transversely with respect to the longitudinal direction of the table element. The outside diameter of the first spacer is smaller than the inside diameter of the second spacer, or rather than the diameter of the passage opening in the second spacer. In order to prevent spacers projecting out of the frontmost or rearmost table element on the outside of the table or rather when viewed from the front or from the rear, the frontmost (or the rearmost) table element is preferably reversed, i.e. the frontmost table element comprises an orientation that has been rotated by 180 degrees in the circumferential direction of the folding table, i.e. an orientation which is reversed compared to the remaining table elements. In this case, the first spacer of the frontmost table element is inserted into the passage opening of the second spacer of the second frontmost, or rather next table element adjacent the frontmost table element, and the first spacer of the next table element adjacent the frontmost table element is inserted or plugged into the passage opening of the second spacer of the frontmost table element. The above-described particular design of the two spacers can avoid the spacing between the second-frontmost table element and the frontmost table element corresponding to twice the length of one spacer, but being only the length of one spacer. Thus, the first, now rearwardly directed first side face of the frontmost table element is located opposite the forwardly directed first side face of the next table element adjacent the frontmost table element.

The folding table according to the invention makes production of the individual table elements particularly simple as all the table elements can be produced in an identical manner.

The individual table elements are preferably coupled together by means of at least one elastic connecting cord or rather a rubber rope or several connecting cords or rubber ropes. It is advantageous, in this case, when each table element comprises at least one passage opening for the passage of the respective elastic cord. In the event of the above-described profile plates which are U-shaped in cross section, this can be four passage openings per table element, when two elastic connecting cords or rather rubber ropes which run in parallel are provided, or when one single elastic connecting cord or rather rubber rope is run through the elements to some extent in a U-shaped manner. It is also possible to provide more than two such connecting cords or rubber ropes parallel to one another. When using only one elastic connecting cord, it is advantageous for it to pass through all the table plates in one direction transversely with respect to the longitudinal axis of the table elements and to be turned around at the frontmost or rearmost table plate in order to pass once again through all the table elements in the reverse direction transversely with respect to the longitudinal axis of the table elements (U-shaped guidance). It is advantageous, in this case, when the passage openings are arranged in the vicinity of the third and of the fourth side faces of the table element, or rather in the two outermost thirds along the longitudinal axis of the table element. The passage openings in the above-described spacers, in this case, can at the same time serve for feeding through the elastic cord or cords.

The elastic cord preferably comprises at least one end which is fastened on the frontmost or rearmost table element or is rather placed against a stop, in a particularly preferred manner by means of a knot or a thickening. In the event of only one elastic connecting cord, both ends of the only one elastic cord are anchored in the same table element. If, for example, two such connecting cords or rather rubber ropes are run parallel to one another, they can comprise such a knot or such a thickening in each case on both sides.

As an alternative to this, two elastic connecting cords can also be used to connect the individual table elements, each of the elastic connecting cords then preferably being fastened by way of one first end on the frontmost table element and by way of one second end on the rearmost table element.

As a result of using an elastic connecting cord, the table elements can be stretched in a slightly pre-tensioned arrangement over the frame of the table, which increases the stability of the folding table and the connection between table top and frame.

As an alternative to connecting the table elements together by means of an elastic cord or elastic webbing, the table elements can also be coupled together, for example, by means of hinges or other suitable connecting elements. Connections in the form of hinges, for example film hinges, are possible, a sewn-in material pocket is also possible, as well as material connections e.g. as a result of textile tapes which are injected, riveted or bonded onto the elements, preferably arranged on the underside of the table plate. It is also quite possible simply to plug the individual table elements together, for example by means of the above-described spacers with adapted diameters or by means of an additional or alternative plug-in connection.

For the purpose of saving material on account of the interest in items of furniture for camping which are as light as possible, according to a preferred embodiment at least one table element, preferably all the table elements forming the table top, comprise a perforated base surface or recesses in the form of holes or material gaps.

According to a particularly preferred embodiment, the first longitudinal rod and the second longitudinal rod are realized in each case from two tube portions which are preferably interconnectable by means of a plug-in connection and preferably have identical outside diameters. Said tube portions are preferably interconnected by means of an adaptor element, which is fixedly fastened at one end in the tube portion and allows the connection of two tube portions with the same diameter.

The first longitudinal rod and the second longitudinal rod are preferably realized in each case in a tubular manner and are connected in each case to at least one of the two front arms or at least one of the two rear arms by means of an elastic cord. According to a particularly preferred embodiment, by means of an elastic cord, the first, left longitudinal rod is connected to the two front arms and the second, right longitudinal rod is connected to the two rear arms.

The connecting rods can be plugged into the connecting elements as individual elements or, however, can be bonded fixedly in each case into at least one connecting element by way of their ends or—as also the arms and legs—can be connected in a captive manner to the connecting rods and/or to another element of the frame by means of elastic cords.

A particularly preferred embodiment is designed in such a manner that the first, front connecting element is connected by means of a first connecting rod and a second connecting rod to the second rear connecting element. In this case, the second connecting rod is preferably arranged parallel to and preferably forming a spacing above the first connecting rod. The two connecting rods are preferably interconnected by means of an elastic cord which preferably runs through at least one of the two connecting elements. The connecting rods are then inserted into two central tube sleeves of the first and second connecting elements.

The front legs and the rear legs, as well as the front arms and the rear arms are preferably designed in each case as tube portions. In this case, the two front legs are preferably interconnected by means of a first elastic cord or rather rubber rope, and the two rear legs are interconnected by means a second elastic cord. The two front arms are interconnected by means of a third elastic cord, and the two rear arms are interconnected by means of a fourth elastic cord. In this case, the first longitudinal rod is preferably connected to the second front arms by means of the third elastic cord, and the second longitudinal rod is connected to the two rear arms by means of the fourth elastic cord. In this case, the respective elastic cord preferably runs through the respective longitudinal rod and then through a coupling element, the elastic cord preferably being turned around in the relevant coupling element and then running through the tubular front or rather rear arm, then through the front or rather rear connecting element and then through the second front or rather rear arm.

This means that, on account of the tension in the elastic cord, assembly of the table is simple without many individual parts and is self-explanatory without the need for instructions, and it can be avoided that individual parts get lost once the table has been disassembled.

The elastic cord, which in each case connects the two front legs or the two front arms or the two rear legs or the two rear arms together, is run through the respective tube portion of the respective two interconnected legs or arms, and is run between the respective interconnected tube portions through the respective front or rear connecting element and is turned there.

Each of the four coupling elements is realized in an angled and preferably integral manner. It preferably comprises a first sleeve portion for receiving a front end or rear end of one of the two longitudinal rods. Each of the four coupling elements also preferably comprises a second sleeve portion which is arranged at an angle to the first sleeve portion and is realized for receiving an upper end of an arm of the frame. The angle described by the two sleeve portions of the coupling element, in this case, is preferably less than 90 degrees.

Each of the four coupling elements preferably comprises, in a longitudinal direction of a respective longitudinal rod, an axial projection which has a smaller diameter than the outside diameter of the first sleeve portion, but a larger diameter than the outside diameter of the longitudinal rods. According to a further preferred embodiment, the axial projection comprises, when viewed from the outside of the table or rather from the front or the back, an inner portion with a smaller diameter and an outer portion with a larger diameter. The inner portion with the smaller diameter consequently forms a circumferential groove or rather annular groove in which the corresponding recess in the second side face of the frontmost or rather rearmost table plate is able to engage. As a result of said design of the coupling elements, the table top can be prevented from being able to slip forward or rearward on the frame as the side face is caught in the circumferential groove.

A circumferential flange, which surrounds the axial projection, preferably forms a stop face on the coupling element for the inside face of a second side face of the table element adjoining the first recess, the second side face extending in the longitudinal direction of a frontmost or rearmost table element and perpendicularly to a base surface of the frontmost or rearmost table element.

During assembly, once the table top has been assembled, the table top is preferably stretched as a result of pulling or clamping the frontmost and rearmost table element over at least one of the front coupling elements and at least one of the rear coupling elements, preferably over the two front and the two rear coupling elements.

As already mentioned beforehand, the table top can be formed, as an alternative to the plate elements, by a textile fabric or rather a woven or braided cloth which, for example, can be pulled over the coupling elements on the free ends of the frame by means of pockets in its corners, or can be fastened on the coupling elements by means of moulded parts on the cloth (for example injection-moulded parts or attachments produced from plastics material or leather). Possible materials for the table top are fabrics that are coated on one side or both sides or are uncoated and are produced from natural and/or synthetic fibres. The textile fabric comprises pockets in which, in each case, at least one table element, e.g. one plate element, can be inserted. The table elements, in this case, are preferably produced from plastics material. In this case, instead of one flat plate element, for example several hollow-bar-shaped, connected or individual inserts can also be inserted in each case into a textile pocket. The textile table top can then, for example, be rolled out on the frame to some extent as a roller plate and fastened thereon.

The disclosure in WO 2016/055280 A1 is also expressly included in the disclosure of this application with regard to the design of the feet, as well as of the tube plugs and the fixing of the ends of the elastic cords.

Further exemplary embodiments are described in the dependent claims.

BRIEF DESCRIPTION OF THE DRAWINGS

Preferred embodiments of the invention are described below by way of the drawings which simply serve for explanation, are not to be interpreted as restricting and in which:

FIG. 4 shows a detailed view of the section Z of FIG. 3*a*, which shows a recess in the side face of a table element;

FIG. 5 shows a detailed view of the section Y of FIG. 2*b;*

FIG. 6*a* shows a detailed view of the plug-in connection of the two table elements according to FIG. 3*a* in a perspective view;

FIG. 6*b* shows a detailed view of the plug-in connection of the two table elements according to FIG. 3*a* in a sectional representation;

FIG. 6*c* shows a detailed view of the plug-in connection of the two table elements according to FIG. 3*a* in a perspective view;

FIG. 6*d* shows a detailed view of the plug-in connection of the two table elements according to FIG. 3*a* in a sectional representation;

DESCRIPTION OF PREFERRED EMBODIMENTS

Figure 1:
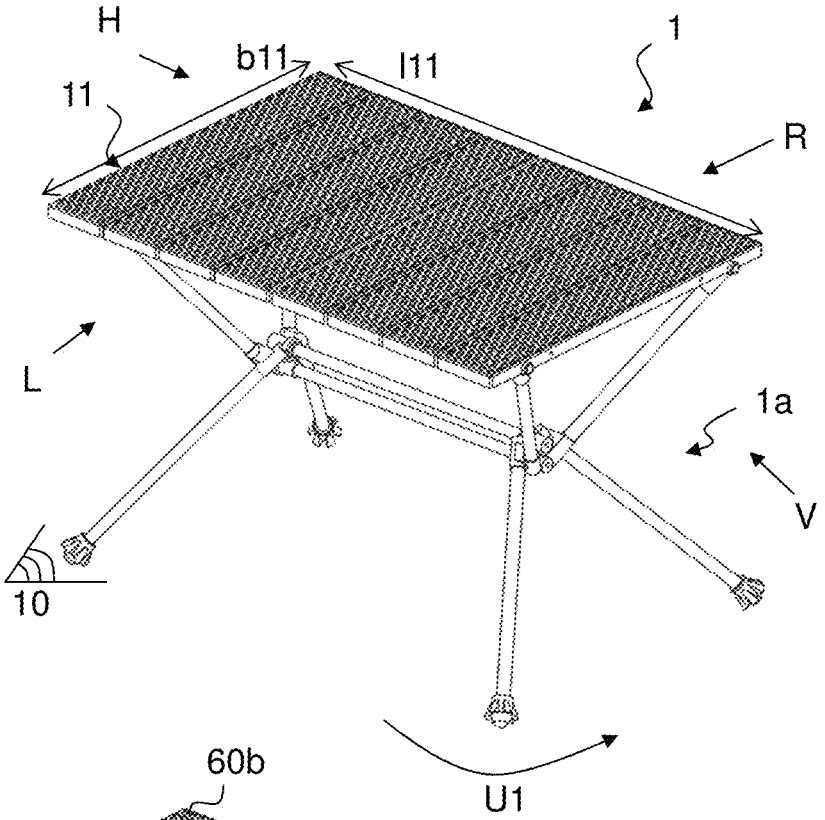
FIG. 1 shows a perspective view of the folding table according to a first embodiment, in the assembled state with table top fitted.
Figure 2A:
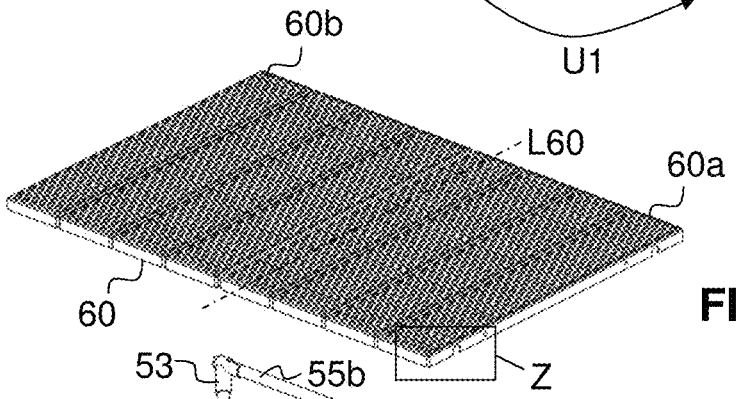
FIG. 2*a* shows a perspective view of the raised table top of the folding table of FIG. 1.

FIG. 1 shows a portable table or rather folding table 1 according to the invention according to a first exemplary embodiment in the assembled state. In this case, a table top 11 or rather table plate rests on a frame 1*a*. The table top 11, which is shown detached from the frame 1*a* in FIG. 2*a*, in the exemplary embodiment shown consists of eight connecting, or rather releasably interlinkable table elements 60, 60*a*, 60*b*, which are realized in the form of rectangular plate or rather profile elements. The table top 11, in the present exemplary embodiment, comprises a length 111 of approximately 600 mm, which corresponds to eight times the width b60 of one table element 60. The table top 11 also comprises a width b11 of 400 mm, the width b11 corresponding to the length 160 of a table element 60. The thickness of the table plate or rather table top corresponds to the thickness h60 of a table element 60 and in the present specific exemplary embodiment is 13 mm.

Figure 2B:
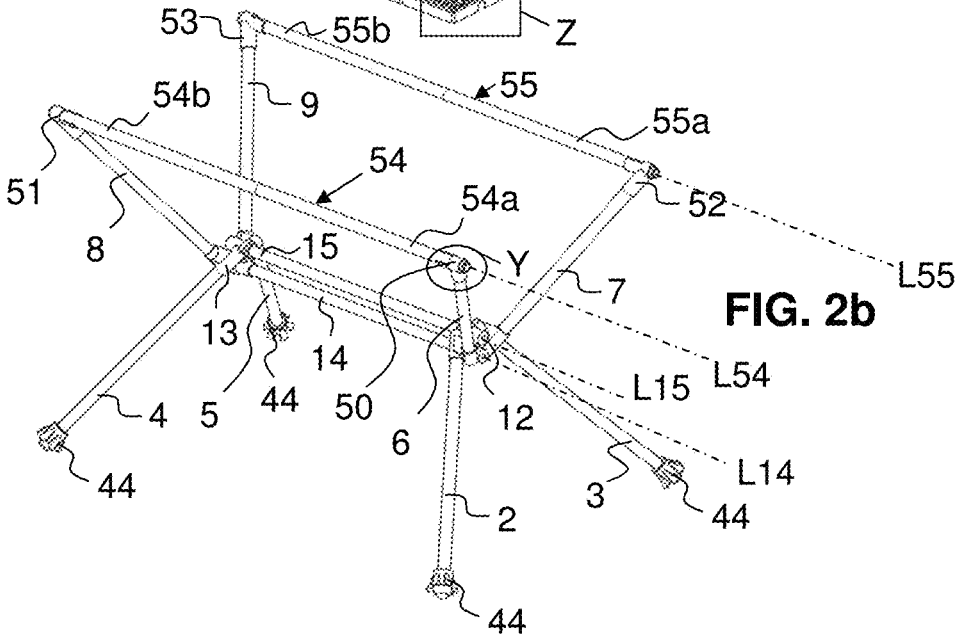
FIG. 2*b* shows a perspective view of the frame of the folding table of FIG. 1.

The frame 1*a* shown detached from the table top 11 in FIG. 2*b* comprises two front legs 2, 3 and two rear legs 4, 5 as well as two front arms 6, 7 and two rear arms 8, 9. The legs 2, 3, 4, 5 comprise in each case a free end 2*a*, 3*a*, 4*a*, 5*a*, which faces downward or rather faces the support 10 or rather the ground, on each of which a foot 44 is fastened which is realized to some extent as a buffer. The two front legs 2, 3 are fastened in a first, front connecting element 12, and the two rear legs 4, 5 are fastened in a second, rear connecting element 13. The front connecting element 12 and the rear connecting element 13, in this case, are interconnected by two connecting rods 14, 15, which are arranged parallel to one another and one above the other thereby realizing a space 48, along the respective longitudinal axis thereof L14 or rather L15.

Figure 13:
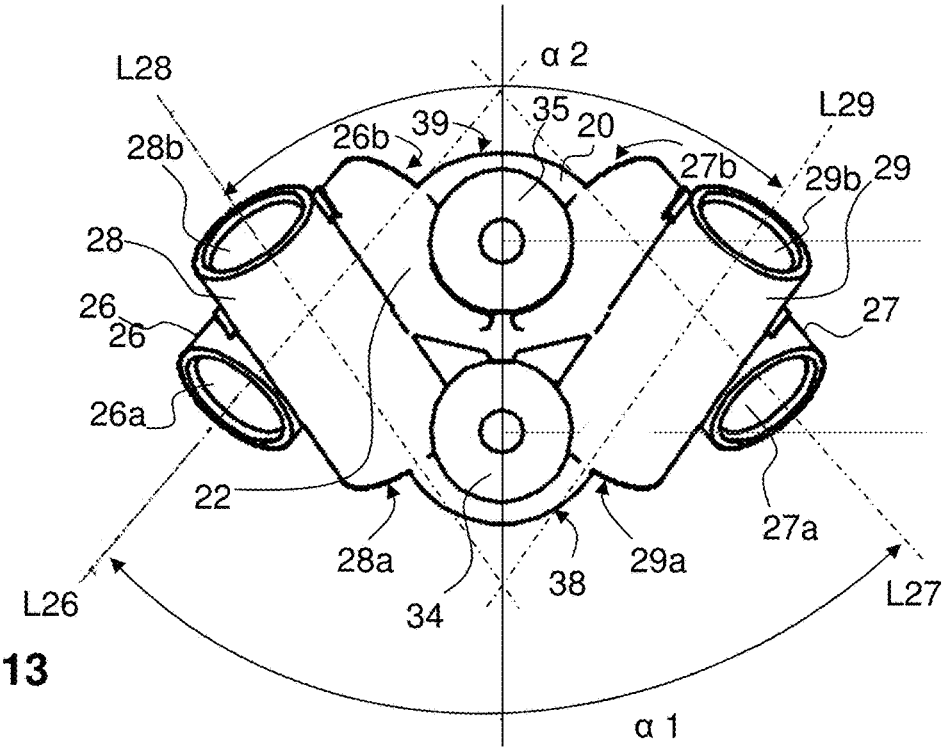
FIG. 13 shows a schematic representation of a view of the first connecting element of the table of FIG. 1 in a front view.
Figure 14A:
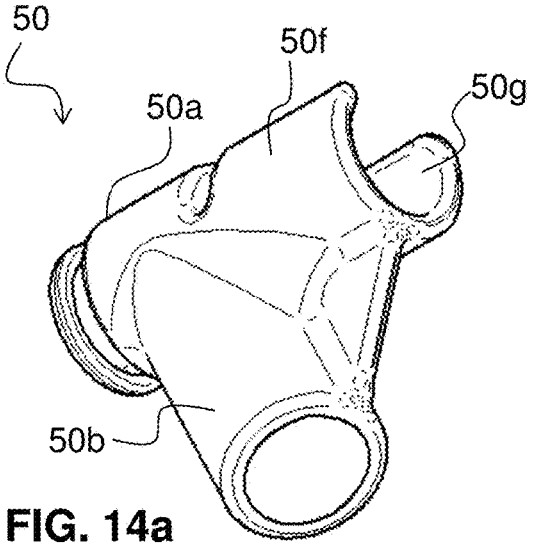
FIG. 14 shows a schematic representation of a coupling element according to a first preferred embodiment, FIG. 14*a*, 14*b* each showing a perspective view, and FIG. 14*c* a side view, FIG. 14*d* a view from the "front" or rather along the longitudinal axis L54/L55, and FIG. 14*e* a view from above.
Figure 14B:
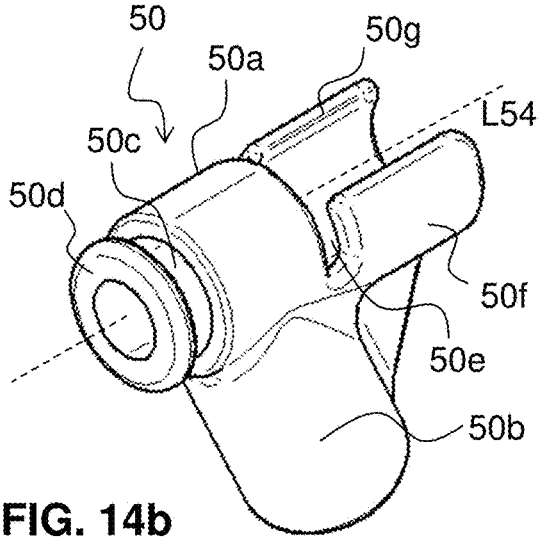
Figure 14C:
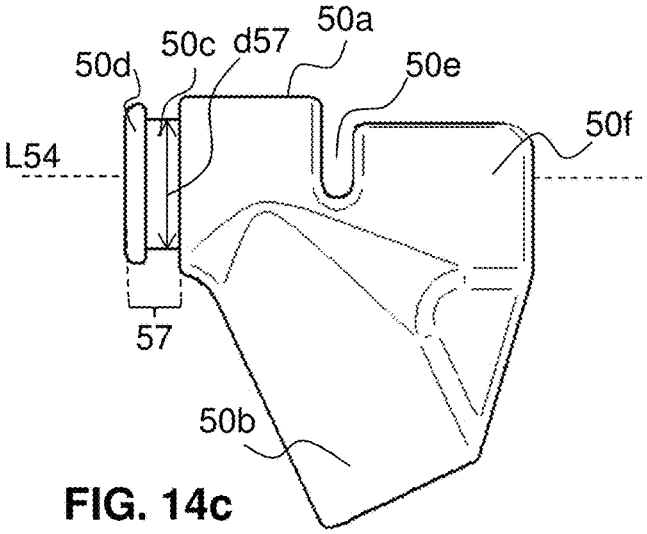
Figure 14D:
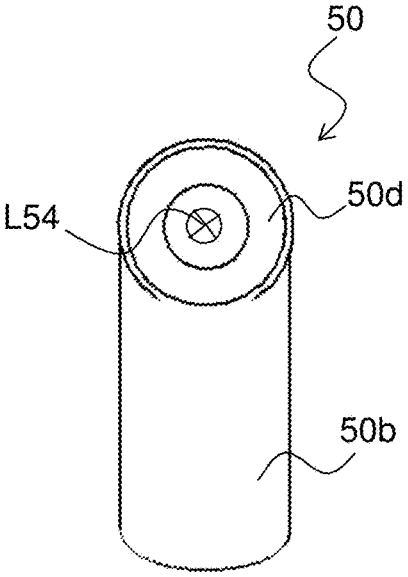
Figure 14E:
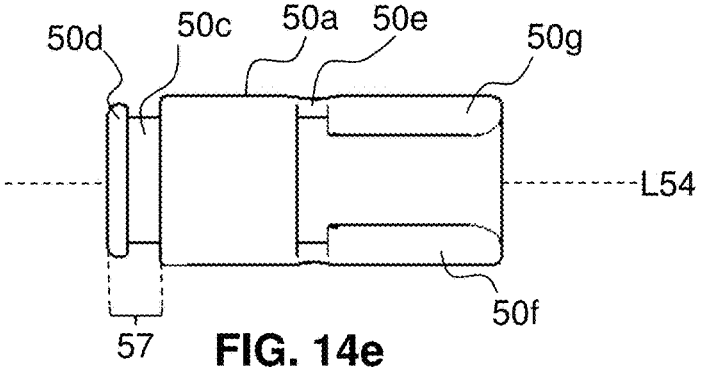

The two front arms 6, 7 are additionally fastened on the first, front connecting element 12, which is shown in an enlarged manner and schematically in a view from the front in FIG. 13, and the two rear arms 8, 9 are fastened on the rear connecting element 13, the arms 6, 7, 8, 9 being inserted in each case by way of their lower end 6*a*, 7*a*, 8*a*, 9*a* into two upper tube sleeves 28, 29 of the respective connecting element 12, 13. The arms 6, 7, 8, 9 comprise in each case a free end 6*b*, 7*b*, 8*b*, 9*b* which points away from the support 10 or rather upward. A coupling element 50, 51, 52, 53, which connects the respective arm 6, 7, 8, 9 to a longitudinal rod 54, 55, is fastened on the upper free end 6*b*, 7*b*, 8*b*, 9*b* of the arms 6, 7, 8, 9. The first, left longitudinal rod 54 connects the front, left arm 6 to the rear, left arm 8, and the second, right longitudinal rod 55 connects the front, right arm 7 to the rear right arm 9. Each of the angular coupling elements 50, 51, 52, 53, in this case, is designed such that a first sleeve portion 50*a*, 51*a*, 52*a*, 53*a* is realized to receive an end 54*c*, 54*d*, 55*c*, 55*d* of the respective longitudinal rod 54, 55, and that a second sleeve portion 50*b*, 51*b*, 52*b*, 53*b*, which is arranged at an angle to the first sleeve portion 50*a*, 51*a*, 52*a*, 53*a*, is realized to receive the upper end 6*b*, 7*b*, 8*b*, 9*b* of the respective arm 6, 7, 8, 9 which is fastened on said coupling element 50, 51, 52, 53. In this case, according to the detailed view in FIG. 4, which shows the section Y of FIG. 2*b*, the first sleeve portion 50*a*, in an axial portion along the longitudinal axis L54 of the longitudinal rod 54, is realized to a certain extent as a hollow cylinder which is closed on one side and in an axial portion comprises a gap in the circumferential direction U54, i.e. is upwardly open and consequently comprises a substantially semi-circular cross section transversely with respect to the longitudinal axis L54 of the longitudinal rod 54. It is also possible to realize said semi-circle in a more closed manner such that, as a result, a latching connection is created. The angle $\alpha 3$, which lies between the two sleeve portions 50*a*, 50*b* and is shown in FIG. 5, is less than 90 degrees.

In the axial direction L54, the front, left coupling element 50, which is shown in FIG. 5 as an example for all four coupling elements 50, 51, 52, 53, comprises an axial projection 57, the outside diameter d57 of which is smaller than the outside diameter d50 of the first sleeve portion 50*a* of the coupling element 50. As a result, a circumferential flange 58 is formed at the transition to the projection 57 on the outside end of the coupling element 50. Said flange serves on the two front coupling elements 50, 52 as a stop for the inside surface 62*a* of a side face 62 of the frontmost plate element 60*a*, and on the two rear coupling elements 51, 53 as a stop for the inside surface 62*a* of a side face 62 of the rearmost plate element 60*b*. Said projections 57 of the coupling elements 50, 51, 52, 53 serve for stretching the table top 11, when said table top is stretched or rather pulled over the frame 1*a*. The other three coupling elements 51, 52, 53 are realized analogously just as the front left coupling element 50.

The further preferred exemplary embodiment of the coupling element 50 in FIG. 4 (also applies, however, in a representative manner to the other three coupling elements 51, 52, 52) comprises, on the projection 57 of the first sleeve portion 50*a*, a circumferential groove 50*c*, in which the respective recess 66*a*, 66*b* of the outside table elements 60*a*, 60*b* can engage. The outside table elements 60*a*, 60*b* can be fixed even better on the frame 1*a* in this manner and are fixed in their position in the direction along the longitudinal axis L54, L55 of the longitudinal rods 54, 55. In other words, in the preferred exemplary embodiment of FIG. 14, the projection 57 comprises a, to some extent, inner portion 50*c* with a smaller diameter, and an outer portion 50*d* with a greater diameter, which forms the front or rather rear closure of the projection 57. The inner portion 50*c* consequently forms a circumferential groove or rather an annular groove. In this case, the diameter d57 of the inner portion 50*c* is only marginally smaller than the diameter of the recess 66*a*, 66*b* in the side face 62 of the frontmost table element 60*a* or rather rearmost table element 60*b*. The width b66 on the lower edge 62*c* of the second side face 62 is insignificantly smaller than the outside diameter d57 of the projection 57 in the region of the annular groove or rather of the inner portion 50*c* and consequently the recess 66*a* or rather 66*b* has to be spread open slightly in order to clamp/clip the frontmost table element 60*a* onto the respective front coupling element 50, 52. In addition, in said preferred exemplary embodiment, in the one axial portion of the first sleeve portion 50*a*, the upwardly open gap in the circumferential direction U54 of the first sleeve portion 50*a* is smaller than in FIG. 5, such that, as a result, a latching connection for the respective longitudinal rod 54, 55 is created. In the exemplary embodiment of FIG. 14, a groove 50*e*, which extends over part of the circumference U54, is arranged between the upwardly open axial portion of the first sleeve portion 50*a* and the closed axial portion of the first sleeve portion 50*a*, as a result of which the upwardly open axial portion and the closed axial portion of the first sleeve portion 50*a* are spaced apart from one another and, to some extent, two "clamping jaws" 50*f*, 50*g* are formed. This serves additionally, along with the saving in material and consequently weight, for increased flexibility of the two clamping jaws of the upwardly open circumferential portion when the longitudinal rod 54 or rather 55 is clamped.

The two longitudinal rods 54, 55, in the exemplary embodiment of FIG. 1, are arranged parallel to the two connecting rods 14, 15 and, when viewed in a direction transversely with respect to their longitudinal axes L54, L55, opposite one another and parallel to one another. In the exploded view of FIG. 11, it can be seen that the first longitudinal rod 54 and the second longitudinal rod 55 are realized in each case from two tube portions 54*a*, 54*b*, or rather 55*a*, 55*b*, which are preferably interconnectable by means of a plug-in connection. They are interconnected by means of an adapter element 54*e* or rather 55*e*. So that the elastic cord 19 is able to be run through the respective adapter element 54*e*, the adapter element also comprises an axial passage opening or rather a through-bore. A first portion of the adapter element 54*e* is admitted in one of the two tube portions 54*a*, 55*a* and is fixedly connected thereto, the respective other tube portion 54*b*, 55*b* of the respective longitudinal rod 54, 55 being able to be fitted onto the second portion of the adapter element 54*e* which projects out of the first tube portion 54*a*, 55*a* or rather being releasably connectable to the first tube portion 54*a*, 55*a* via the adapter element 54*e*.

According to FIG. 13, each connecting element 12, 13 comprises six tubular sleeves 26-32 fastened thereon which serve for receiving the respective legs 2, 3 or rather 4, 5, arms 6, 7 or rather 8, 9 and the two connecting rods 14, 15. When viewed from the front, the front connecting element 12 and, when viewed from the rear, the rear connecting element 13 comprise a left, lower tubular sleeve 26 for receiving the left, front leg 2 or rather the right, rear leg 5, as well as a right lower tubular sleeve 27 for receiving the right, front leg 3 or rather the left rear leg 4. Equally, when viewed from the front, the front connecting element 12 and, when viewed from the rear, the rear connecting element 13 comprise a left, upper tubular sleeve 28 for receiving the left, front arm 6 or rather the right, rear arm 9, as well as a right, upper tubular sleeve 29 for receiving the right, front arm 7 or rather the left, rear arm 8. In each connecting element, the four tubular sleeves 26, 27, 28, 29 for receiving the respective two legs 2, 3 or rather 4,5 and the respective arms 6, 7 or rather 8, 9 are interconnected substantially by means of a plate 20, which at the same time serves as a reinforcement rib 38, 39 between the respective two lower tubular sleeves 26, 27, or rather the respective upper tubular sleeves 28, 29.

In the exemplary embodiment shown, the arms 6, 7, 8, 9 are fastened further outside, i.e. further forward or rather further rearward on the respective connecting element 12, 13 than the corresponding legs 2, 3, 4, 5.

In addition, each connecting element 12, 13 comprises two central tubular sleeves 34, 35, which are arranged one above the other and parallel to one another, for receiving one end of a connecting rod 14, 15 each, said connecting rod connecting the front connecting element 12 to the rear connecting element 13. Said central tubular sleeves 34, 35 are arranged transversely with respect to the direction of extension of the plate 20 or rather with respect to the plane of the plate 20 of the respective connecting element 12, 13, or rather pierce the plate 20 to some extent. The central tubular sleeves 34, 35 in the exemplary embodiment shown are closed on the front side 22 of the front connecting element 12, or rather on the rear side of the rear connecting element 13. The two connecting rods 14, 15 extend along their longitudinal axes L14, L15 from front to rear and are arranged one above the other, spaced apart from one another, thereby forming a space 48.

The front legs 2, 3 and rear legs 4, 5 are each arranged with respect to one another at a first acute angle $\alpha 1$ which, in the present exemplary embodiment, is approximately 80 degrees. The front arms 6, 7 are also arranged with respect to one another at a second acute angle $\alpha 2$, which is smaller than the angle $\alpha 1$ spanned between the front legs 2, 3 and, in the present exemplary embodiment, is approximately 70 degrees.

Figure 10:
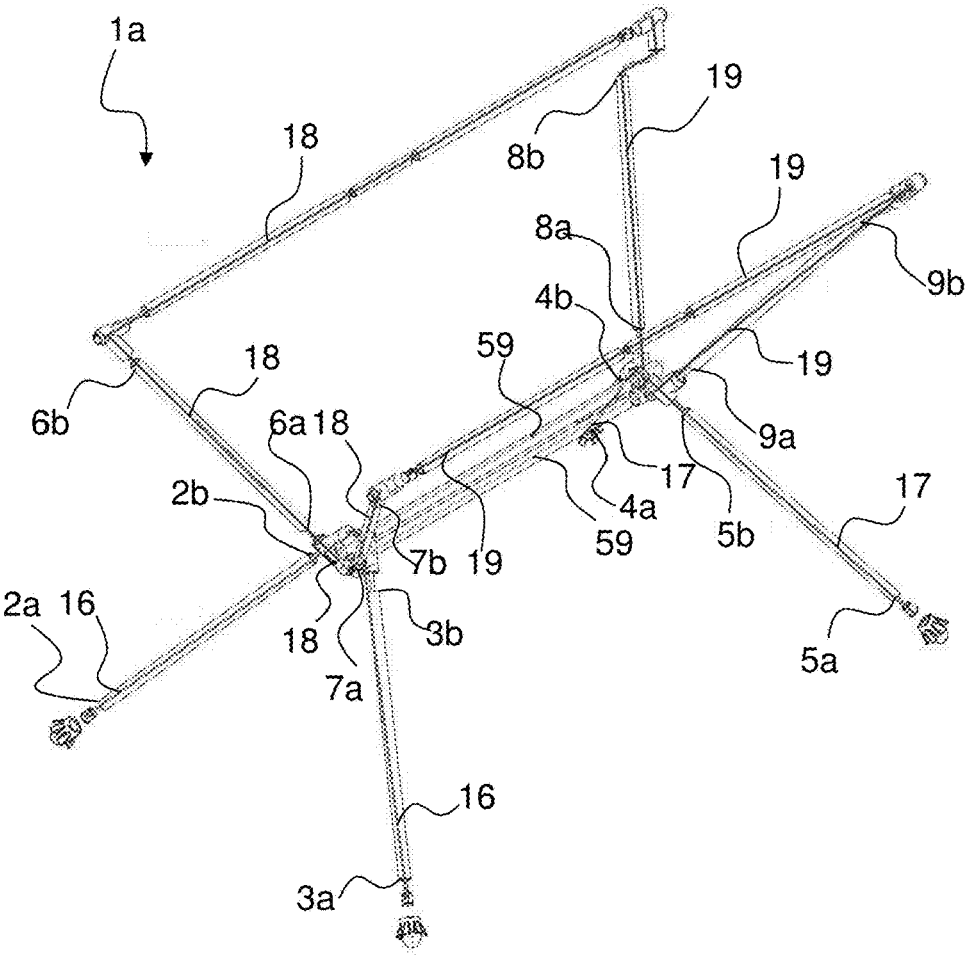
FIG. 10 shows an exploded representation of the frame of FIG. 2*b* without any table top, with inserted rubber ropes, the running of the cord between the individual tube segments being shown in a schematic manner.
Figure 11:
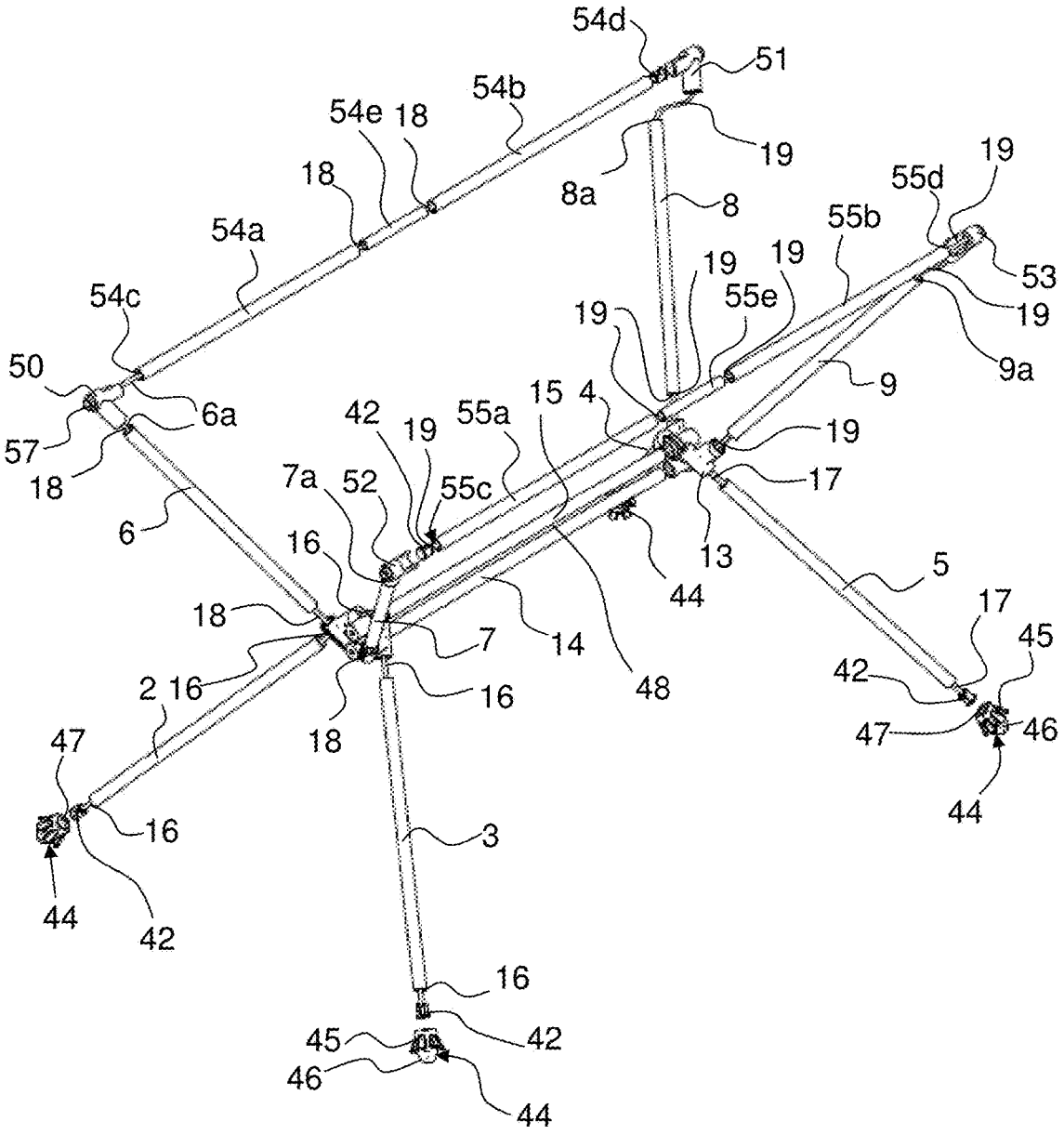
FIG. 11 shows an exploded representation of the frame of FIG. 2*b* without any table top.

In the exploded view in FIG. 10, showing the running of the cord, it can be seen that in each case two legs 2, 3 or rather 4, 5 and in each case two arms 6, 7 or rather 8, 9 are interconnected in each case by an elastic cord 16, 17, 18, 19. The table 1, in the exemplary embodiment shown in FIG. 5, comprises five such elastic cords 16, 17, 18, 19, 59. In this case, each elastic cord 16, 17, 18, 19, which runs through a leg 2, 3, 4, 5 or an arm 6, 7, 8, 9, is turned around in the connecting element 12, 13 in order to enter there into the leg 2, 3, 4, 5 respectively adjacent in the circumferential direction U of the table 1 or rather into the arm 6, 7, 8, 9 respectively adjacent in the circumferential direction U of the table 1, which arm/leg is pivotally mounted on the same connecting element 12, 13. Each elastic cord 16, 17, 18, 19, in this case, comprises two ends. Each of said ends, as illustrated in FIG. 11, is anchored in a tube plug 42. The tube plug 42, in this case, comprises a cylindrical portion, which comprises a cavity or rather a recess, and is provided on its side facing the periphery with a bottom, which comprises a circumferential flange, which rests on the end of the respective leg or arm and closes the tubular portion of the respective leg or arm. The elastic cord 16, 17, 18, 19 comprises, at its two ends, for example, a knot which is inserted into the recess of the tube plug 42 on assembly and finds a stop in a tapering of the recess, it being possible for the elastic cord to enter into the respective tubular portion through the tapered recess.

The way in which the elastic cord 16 runs is explained below as an example by way of the two front legs 2, 3, but is also applicable in an analogous manner to the way in which the elastic cord 17 of the rear legs 4, 5 runs.

As can be seen in the exploded representation in FIG. 10 or 11, the elastic cord 16 runs from its anchor point with its first end in the tube plug 42 of the left, front leg 2 through the tubular portion of the front left leg 2. At the front connecting element 12, the right leg 3 enters into the lower opening 30*a* of the left, lower tubular sleeve 26*a* (shown in detail in FIG. 13) and the elastic cord 16 leaves the front connecting element 12 through the upper opening 26*b*, its direction is turned around here and it enters into the tubular portion of the right, front leg 3 through the upper opening 27*b* of the right, lower tubular sleeve 27. The elastic cord 16 then runs through the right, front leg 3 until it is anchored at its second end again in a tube plug 42 of the right, front leg 3.

The tube plug 42 forms the closure on the arms 6, 7, 8, 9 or rather the upper end of the arm 6, 7, 8, 9. A foot 44 is additionally mounted on the legs 2, 3, 4, 5 over the end of the respective leg 2, 3, 4, 5 which is closed by way of the tube plug 42. In this case, the end of the leg 2, 3, 4, 5 is received in a blind hole 47 in the foot and is fastened therein, for example stuck down or pressed thereon. The foot 44 shown in FIG. 10 additionally comprises a tip 46 for supporting the table 1 on the support 10. The foot 44 additionally comprises an annulus produced from several radial wings 45 which extend radially outward from one another at regular intervals and enlarge the surface of the foot 44 in contact with the support 10. This is particularly helpful when the support is soft, such as, for example, a forest floor, where the tip 46 sinks into the ground. The form and design of the feet can be constructed to deviate and be exchangeable in dependence on the ground conditions.

Each connecting element 12, 13, of which the front connecting element 12 is shown in more detail in FIG. 13 as an example, forms, to some extent, a bulb with six tubular sleeves 26, 27, 28, 29, 34, 35. In this case, the upper tubular sleeves 28, 29 for the arms 6, 7 are interconnected at their lower end by a first or rather lower reinforcement rib 38, and at their upper end by way of a second or rather upper reinforcement rib 39. The lower tubular sleeves 26, 27 for the legs 2, 3 are then to some extent integrally moulded in one piece on said reinforcement ribs 38, 39. The tubular sleeves 26, 27 for the legs 2, 3 pass through the respective upper reinforcement rib 39. As a result, the upper end of the respective tubular sleeve 26, 27 comes to rest on the opposite side of the respective upper reinforcement rib 39 as the lower end of the respective tubular sleeve 26, 27. Consequently, the upper openings 26*b*, 27*b* of the front leg-tubular sleeves 26, 27 are arranged on the rear side 23 of the front connecting element 12, and the lower openings 26*a*, 27*a* on the front side 22 of the front connecting element 12. In other words, in each case one upper tubular sleeve 28, 29 intersects a lower tubular sleeve 26, 27 on a left and on a right side of the connecting element 12 shown. The rear connecting element is designed in an analogous manner, the view of the front connecting element from the front V corresponding to the view of the rear connecting element from the rear H.

The connecting element 12 seems somewhat as if it is formed from a plate 20 (which forms the reinforcement ribs), on which the six tubular sleeves are integrally formed, the plate extending at the angle $\alpha 2$ in the plane spanned by the respective arms 6, 7 substantially in a direction transversely with respect to the extension direction L14, L15 of the connecting rods 14, 15. The plate 20, in this case, is substantially in the form of a circle segment.

Figure 12:
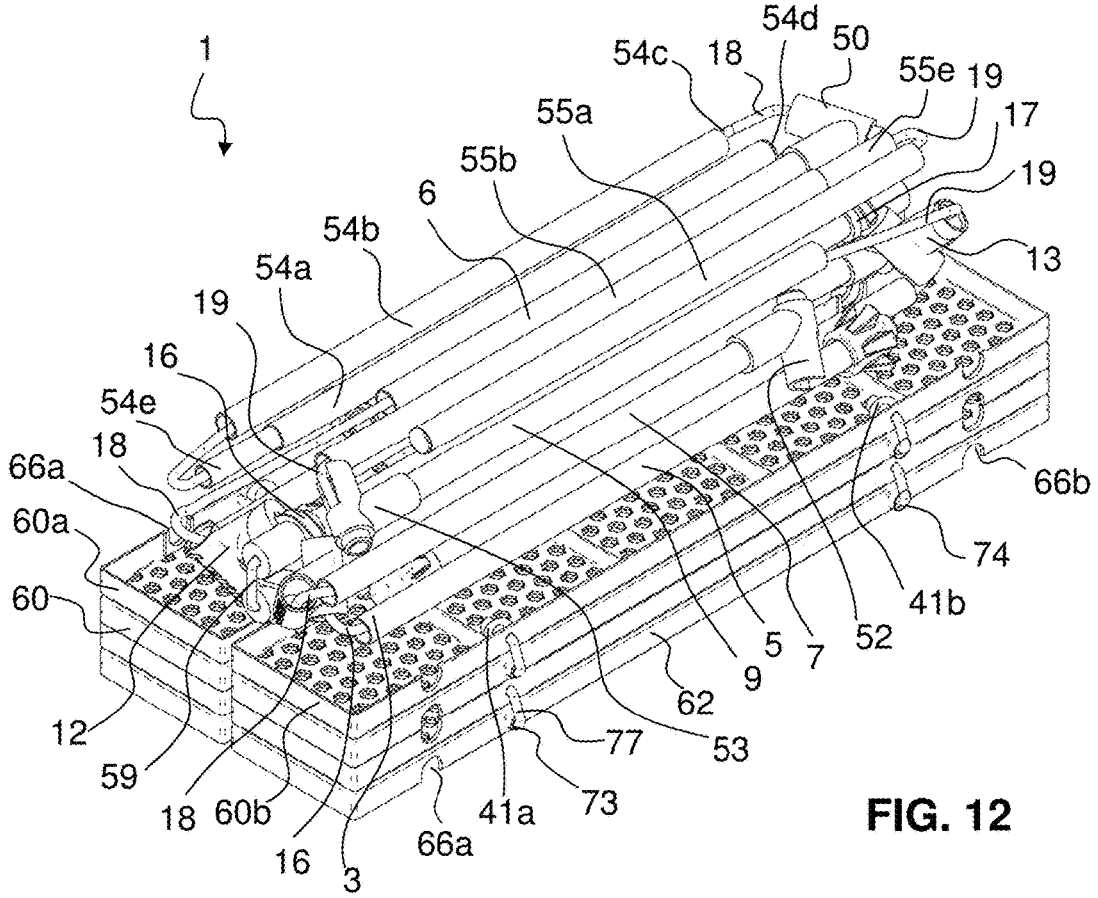
FIG. 12 shows a perspective view of the folding table of FIG. 1 in the folded state packed down as small as possible.

FIG. 12 shows a table 1 according to the invention in a collapsed state packed down as small as possible, it being worthy of note that one single stack or a different arrangement is also possible. First of all, the table top 11 is lifted from the frame 1*a* and folded up. In this case, of the eight table elements 60, 60*a*, 60*b* in each case four are placed on top of one another, which produces two stacks of table elements. When folding up the shown frame 1*a*, the two connecting rods 14, 15 remain connected to the respective connecting element 12, 13. The respective two legs 2,3/4,5 and arms 6,7/8,9 are pulled out of the respective tubular sleeve 26,27/28,29/30,31/32,33 and laid parallel to the longitudinal axis L14, L15 of the connecting rods 14, 15 on said connecting rods 14, 15. When folding the frame 1*a*, the two tube portions 54*a*, 54*b* or rather 55*a*, 55*b* of the longitudinal rods 54, 55 are additionally separated from one another and laid on the connecting rods 14, 15 and on the arms 6, 7, 8, 9 and legs 2, 3, 4, 5. The folded frame 1*a* is then laid on the folded table top and they are packed or rather stowed together.

In the exemplary embodiment shown in FIG. 1, the table elements 60 are realized as perforated plate elements or rather profile elements. The holes 71 present in the exemplary embodiment shown are material gaps with a hexagonal basic form which serve, in particular, for weight reduction and result in the table element 60 having a grid-like structure. However, the plates can also be continuous and have a closed surface.

Figure 3A:
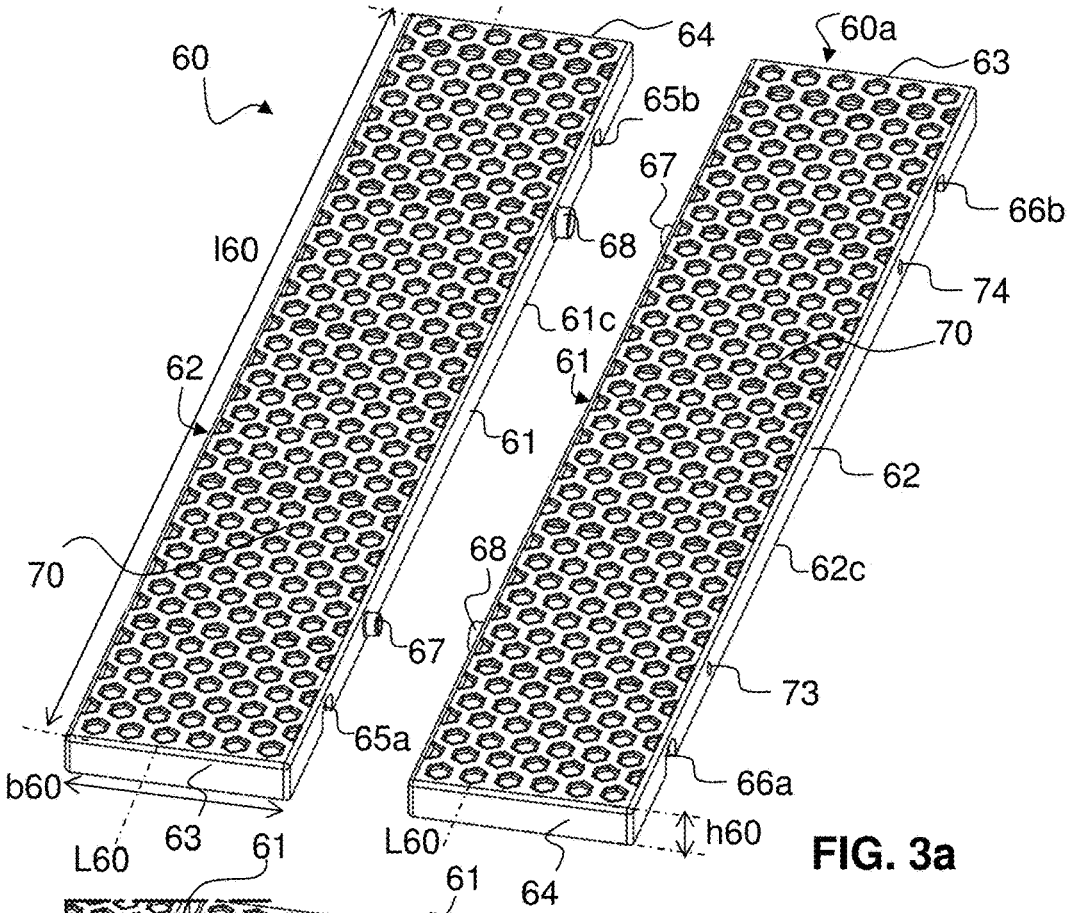
FIG. 3*a* shows a detailed view of two table elements, separated from one another, of the table top of FIG. 2*a;*

FIG. 3*a* shows the frontmost table element 60*a* and FIG. 3*a* the next table element 60 adjacent the frontmost table element 60*a* in detail. The table elements 60, 60*a*, in this case, comprise a base surface 70, the totality of the base surfaces 70 of all the table elements 60, 60*a*, 60*b* forming the table top 11 forming the table surface of the portable table 1. The base surface 70 of each table element 60 is delimited by four side faces 61, 62, 63, 64 which extend downward perpendicularly from the base surface 70, i.e. toward the frame 1*a* or rather toward the support 10. Consequently, the table element 60 is realized, to some extent, as a plate element which comprises, to some extent, a U-shaped cross section, the legs of the formed "U" extending downward. In this case, the first side face 61 is arranged parallel to the second side face 62, which is situated opposite the first side face in a direction transversely with respect to the longitudinal axis L60 of the table element 60. The third side face 63 is arranged at right angles to the first and second side faces 61, 62 and parallel to the fourth side face 64, which is situated opposite the third side face 63 in a direction along the longitudinal axis L60 of the table element 60.

A table element 60, 60*a*, 60*b*, in the present exemplary embodiment, has a length 160 of 400 mm, measured along the longitudinal axis L60 and consequently in a direction transversely with respect to the longitudinal axis L14 of the connecting rod L14, or rather with respect to the longitudinal axis of the longitudinal rod L54. The width b60 of a table element 60, in this case, in the present exemplary embodiment, is approximately 70 mm, measured transversely with respect to the longitudinal axis L60 of the table element along the third or rather fourth side face 63, 64. The thickness h60 of a table element or rather the height of the side faces 61, 62, 63, 64 here is approximately 75 mm.

Figure 7:
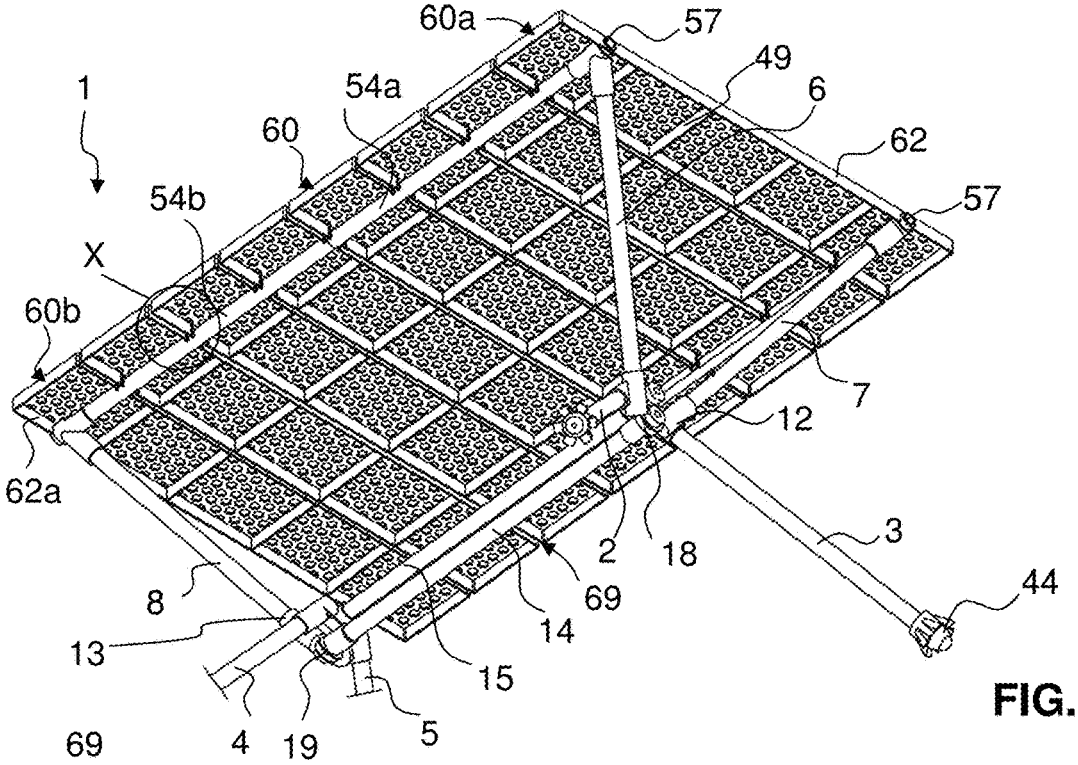
FIG. 7 shows a perspective bottom view of the folding table of FIG. 1, the connecting cords of the table elements not being shown and the rear legs being shown incompletely.

In the bottom view in FIG. 7, it can be seen that each table element 60, 60*a*, 60*b*, on the underside 70*a* of its base surface, comprises a plurality of cross struts 49 which serve for stability. Said cross struts 49 are arranged in a direction transversely with respect to the longitudinal axis L60 of the table element 60, extend downward from the base surface 70 toward the support 10 and connect the first side face 61 to the second side face 62.

Figure 3B:
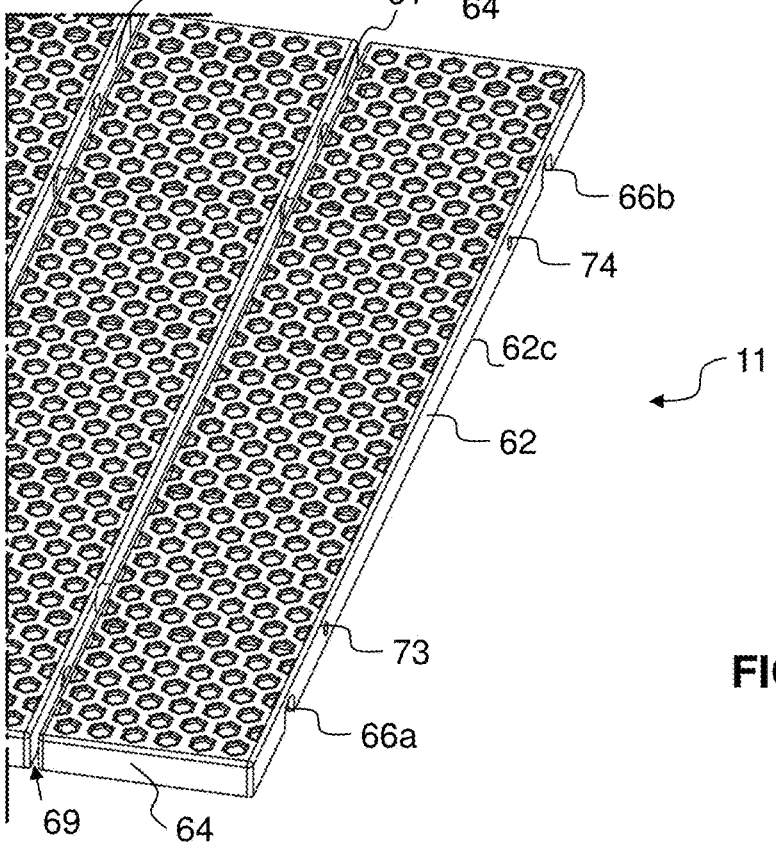
FIG. 3*b* shows a section of the front region of the table top of FIG. 2*a*, three table elements being shown in the assembled state.

As shown in FIGS. 3*a* and 3*b*, the second side face 62 of the frontmost table element 60*a* comprises two recesses 66*a*, 66*b* which are spaced apart from one another and serve for fastening the table top 11 on the front two coupling elements 50, 52. In this case, the first recess 66*a*, which is shown in an enlarged manner in FIG. 4, is clamped onto the front, left coupling element 50, and the second recess 66*b* is clamped onto the front, right coupling element 52. The recess 66*a*, 66*b*, in this case, consequently snaps over the axial projection 57 of the respective coupling element 50, 52, by the width b66 on the lower edge 62*c* of the second side face 62 being insignificantly smaller than the outside diameter d57 of the projection 57 and the recess 66*a* or rather 66*b* consequently having to be spread open slightly in order to clamp/clip the frontmost table element 60*a* onto the respective front coupling element 50, 52. The outside diameter d54, d55 of the two longitudinal rods 54, 55 is marginally smaller than the width b66 of the first recess 66*a* and of the second recess 66*b* on the lower edge 62*c* of the second side face 62, as well as marginally smaller than the width b65 of the first recess 65*a* and of the second recess 65*b* on the lower edge 61*c* of the first side face 61. Consequently, all the table elements 60 rest with their recesses 65*a*, 65*b*, 66*a*, 66*b* on the longitudinal rods 54, 55, whilst the recesses 66*a*, 66*b* of the frontmost and the rearmost table elements 60*a*, 60*b* are only clampable onto the coupling elements 50, 51, 52, 53 as a result of overcoming a friction force. However, it is possible for all the table elements not only to rest on but to be connected to the substructure by means of a latching connection.

The table top 11 projects above the longitudinal rods 54, 55 in a direction along the longitudinal axis L60 of a table element 60, which is arranged transversely with respect to the longitudinal axis L54 of the longitudinal rods 54, 55. The table top 11 equally also projects above a plane which is spanned by the four feet 44 of the frame 1*a* on the support 10.

Figure 9A:
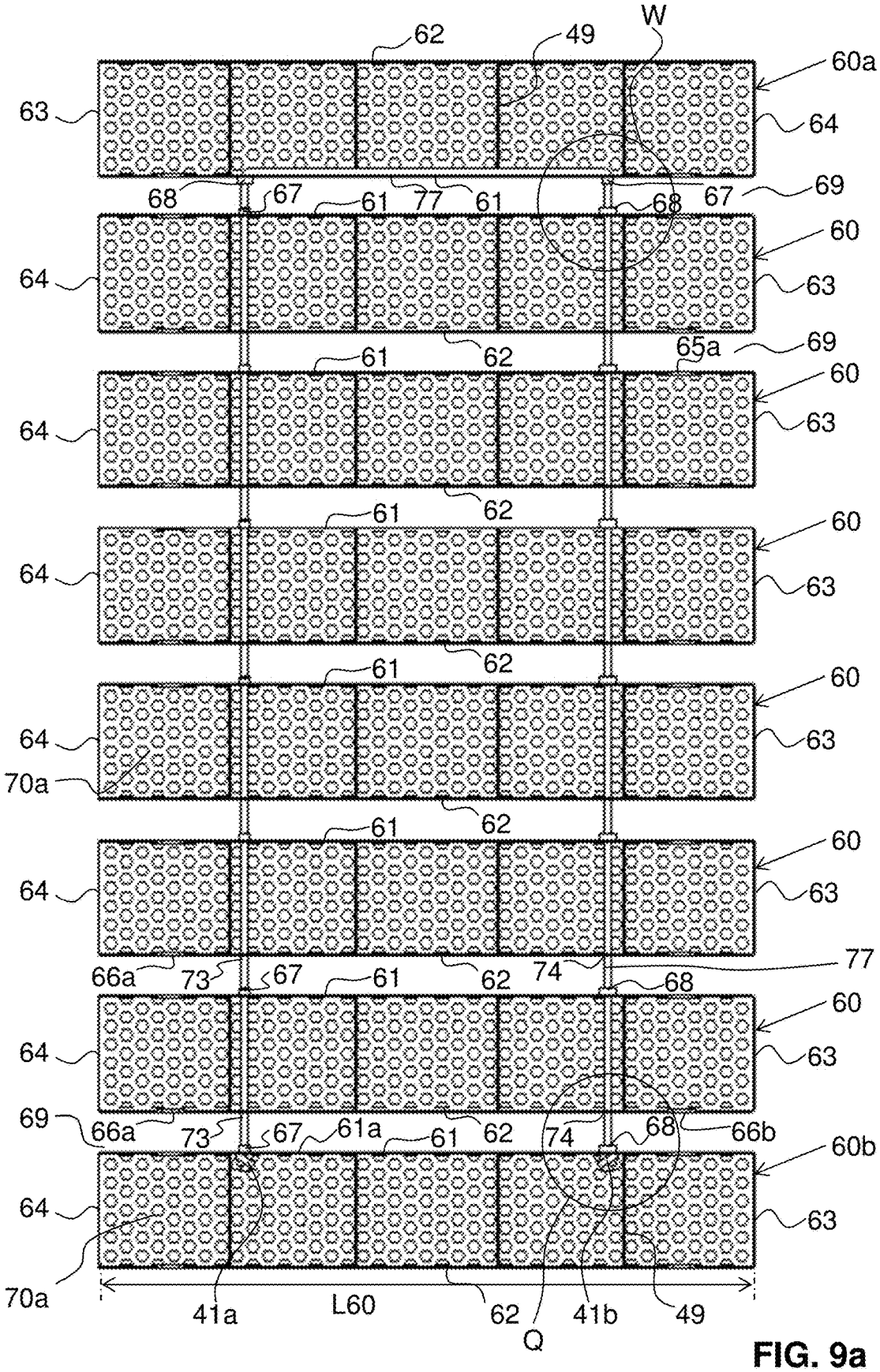
FIG. 9*a* shows a bottom view of the table top of FIG. 2*a* with a connecting cord.
Figure 9B:
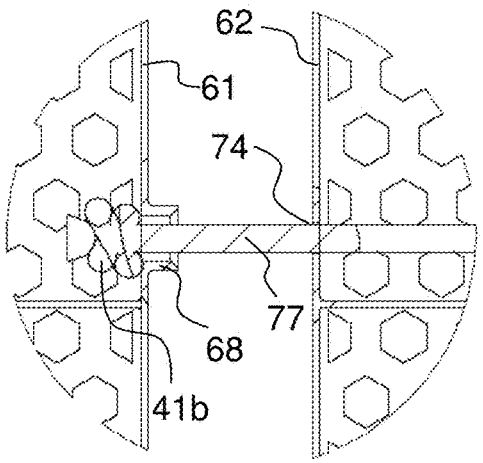
FIG. 9*b* shows a detailed view of the section Q of FIG. 9*a;*
Figure 9C:
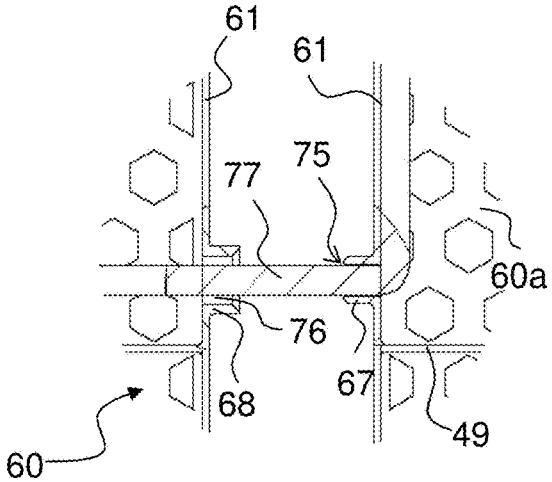
FIG. 9*c* shows a detailed view of the section W of FIG. 9*a;*

In the exemplary embodiment shown, the table elements 60, 60*a*, 60*b* are interconnected by an elastic connecting cord 77, as shown in FIGS. 9*a-c*, the front and the rear ends of the elastic cord 77 being arranged as knots 41*a*, 41*b* on the underside 70*a* of the rearmost table element 60*b*. This is shown in an enlarged manner in the view of a detail in FIG. 9*b*. In the exemplary embodiment shown in FIG. 9*a*, the eight table elements 60 are coupled together by means of only one elastic connecting cord 77, i.e. the connecting cord 77 is anchored on the underside 70*a* of the rearmost table element 60*b* by way of a first knot 41*a*, run through all the table elements 60 located in between up to the frontmost table element 60*a*, turned around on the underside 70*a* of the frontmost table element 60*a* along the inside surface 61*a* of the first side face 61, as shown in an enlarged manner in FIG. 9*c*, and run again through all the table elements 60 located in between up to the rearmost table element 60*b* and there is anchored once again by means of a knot 41*b* on the inside surface 61*a* of the first side face 61.

When leaving each table element 60*b*, the elastic cord 77 passes through the passage opening 75 of the first spacer 67 in the first side face 61, crosses the space 69, is then guided through the first hole 73 in the second side face 62 of the first adjacent table element 60, then along the underside of the base surface 70, and once again through the passage opening 75 of the first spacer of the first adjacent table element 60, etc. In the transition to the frontmost table element 60*a*, the elastic connecting cord 77 leaves the passage opening 75 of the first spacer 67 in the first side face 61 of the table element 60 which is arranged adjacent the frontmost table element 60*a*, passes through the space 69 and then passes through the passage opening 76 of the second spacer 68 to the inside surface 61*a* of the first side face 61 of the frontmost table element 60*a*. Here, therefore, two first side faces 61 are located opposite one another as the frontmost table element 60*a* has been rotated by 180 degrees in order to avoid spacers protruding on the front outside surface beyond the table plate. Consequently, all the table elements 60, 60*b*, which are realized in an identical manner, have this same orientation, with the exception of the frontmost table element 60*a*, which has the opposite orientation. As a result of rotating the frontmost table element 60*a* about 180 degrees, in each case a first spacer 67 comes to rest opposite a second spacer 68. The first spacer 67 comprises a smaller outside diameter d67 than the outside diameter of the second spacer 68, and, in this case, is only marginally smaller than the inside diameter d68 of the second spacer 68, which enables a releasable or even loose plug-in connection between the first spacer 67 and the second spacer 68. When tightening the front two table elements 60, 60*a* elastically or rather laying them next to each other, on account of the smaller outside diameter d67 of the first spacer 67, the first spacer 67 of the adjacent table element 60 next to the frontmost table element 60*a* can then be inserted into the second spacer 68 of the frontmost table element 60*a*. This prevents the frontmost table element 60*a* being at a double spacing, which would be produced from the sum of the length 167 of the first spacer 67 and the length 168 of the second spacer 68, from the next adjacent table element 60 in the adjoining space 69, the two lengths 167, 168 being identical, and in the present exemplary embodiment, being approximately 4 mm. The table elements 60 arranged between the frontmost table element 60*a* and the rearmost table element 60*b* consequently abut against one another, whilst a plug-in connection by means of the respective spacers 67, 68 is produced between the frontmost table element 60*a* and the next adjacent table element 60. As an alternative to this, instead of the frontmost table element 60*a*, the rearmost table element 60*b* could also be arranged in a rotated manner and the plug-in connection would then be between the spacers 67, 68 of the rearmost table element 60*b* and the spacers 67, 68 of the table element 60 adjacent the rearmost table element 60*b*.

After putting together the foldable frame 1*a* and unfolding or rather undoing the table elements 60, 60*a*, 60*b* forming the table top 11, the frontmost table element 60*a* and the rearmost table element 60*b* are stretched over the front and rear ends of the frame 1*a* or rather over the four coupling elements 50, 51, 52, 53, which bestows a certain inherent tension and stability on the table top 11. In this case, the tensioning of the elastic connecting cord 77 is adjusted in such a manner that the table elements 60, 60*a*, 60*b* are arranged in a slightly tensioned manner on the frame, the frontmost table element 60*a* and the rearmost table element 60*b* being clamped on the coupling elements 50, 51, 52, 53 and the remaining table elements resting in each case with or without clamping on the first and the second longitudinal rods 54, 55.

LIST OF REFERENCES

| | |
|---|---|
| 1 | Portable table |
| 1a | Frame of 1 |
| 2 | Left, front leg of 1a |
| 2a | Lower, first end of 2 |
| 2b | Upper, second end of 2 |
| 3 | Right, front leg of 1a |
| 3a | Lower, first end of 3 |
| 3b | Upper, second end of 3 |
| 4 | Left, rear leg of 1a |
| 4a | Lower, first end of 4 |
| 4b | Upper, second end of 4 |
| 5 | Right, rear leg of 1a |
| 5a | Lower, first end of 5 |
| 5b | Upper, second end of 5 |
| 6 | Left, front arm of 1a |
| 6a | Lower, first end of 6 |
| 6b | Upper, second end of 6 |
| 7 | Right, front arm of 1a |
| 7a | Lower, first end of 7 |
| 7b | Upper, second end of 7 |
| 8 | Left, rear arm of 1a |
| 8a | Lower, first end of 8 |
| 8b | Upper, second end of 8 |

-continued

| | |
|---|---|
| 9 | Right, rear arm of 1a |
| 9a | Lower, first end of 9 |
| 9b | Upper, second end of 9 |
| 10 | Support |
| 11 | Table top |
| 12 | First, front connecting element |
| 13 | Second rear connecting element |
| 14 | First, lower connecting rod |
| 15 | Second, upper connecting rod |
| 16 | First elastic cord |
| 17 | Second elastic cord |
| 18 | Third elastic cord |
| 19 | Fourth elastic cord |
| 20 | Plate of 12, 13 |
| 22 | Outside surface of 12, 13 |
| 26 | Left, lower tubular sleeve of 12 for 2 |
| 26a | First, lower opening in 26 |
| 26b | Second, upper opening in 26 |
| 27 | Right, lower tubular sleeve of 12 for 3 |
| 27a | First, lower opening in 27 |
| 27b | Second, upper opening in 27 |
| 28 | Left, upper tubular sleeve of 12 |
| 28a | First, lower opening in 28 |
| 28b | Second, upper opening in 28 |
| 29 | Right, upper tubular sleeve of 12 |
| 29a | First, lower opening in 29 |
| 29b | Second, upper opening in 29 |
| 34 | Lower, central tubular sleeve of 12 for 14 |
| 35 | Upper, central tubular sleeve of 12 for 15 |
| 38 | Lower reinforcement rib |
| 39 | Upper reinforcement rib |
| 41a | First knot on 77 |
| 41b | Second knot on 77 |
| 42 | Tube plug |
| 44 | Foot |
| 45 | Wing of 44 |
| 46 | Tip of 44 |
| 47 | Blind hole in 44 |
| 48 | Space between 14, 15 |
| 49 | Cross strut on 60 |
| 50 | First coupling element |
| 50a | First sleeve portion of 50 |
| 50b | Second sleeve portion of 50 |
| 50c | Inside portion of 50a with a smaller diameter, or rather circumferential groove of 50 |
| 50d | Outside portion of 50a with a larger diameter, or rather circumferential groove of 50 |
| 50e | Groove in 50a |
| 50f | First clamping jaw of 50a |
| 50g | Second clamping jaw of 50a |
| 51 | Second coupling element |
| 51a | First sleeve portion of 51 |
| 51b | Second sleeve portion of 51 |
| 52 | Third coupling element |
| 52a | First sleeve portion of 52 |
| 52b | Second sleeve portion of 52 |
| 53 | Fourth coupling element |
| 53a | First sleeve portion of 53 |
| 53b | Second sleeve portion of 53 |
| 54 | First longitudinal rod |
| 54a | Front tubular portion of 54 |
| 54b | Rear tubular portion of 54 |
| 54c | Front end of 54 |
| 54d | Rear end of 54 |
| 54e | Adapter element of 54 |
| 55 | Second longitudinal rod |
| 55a | Front tubular portion of 55 |
| 55b | Rear tubular portion of 55 |
| 55c | Front end of 55 |

-continued

Figure 8A:
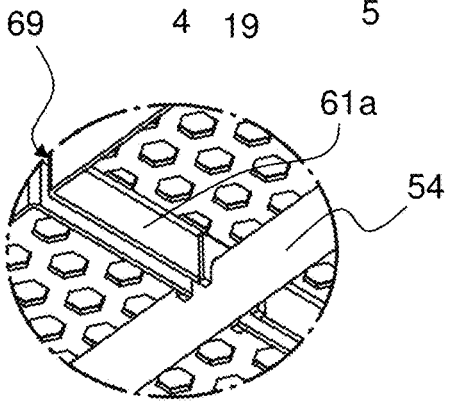
FIG. 8*a* shows a detailed view of the section X of FIG. 5*a* with a longitudinal rod.
Figure 8B:
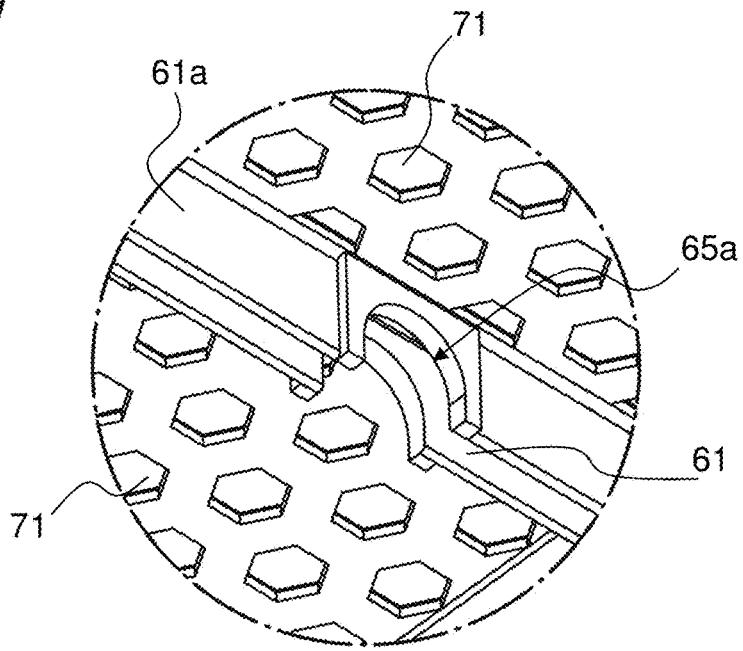
FIG. 8*b* shows a detailed view of the section X of FIG. 5*a* in a larger enlargement and without a longitudinal rod.

| | |
|---|---|
| 55d | Rear end of 55 |
| 55e | Adapter element of 55 |
| 57 | Projection on 50/51/52/53 |
| 58 | Circumferential flange on 50/51/52/53 |
| 59 | Fifth elastic cord |
| 60 | Table element |
| 60a | Frontmost table element |
| 60b | Rearmost table element |
| 61 | First side face of 60 |
| 61a | Inside surface of 61 |
| 61c | Lower edge of 61 |
| 62 | Second side face of 60 |
| 62a | Inside surface of 62 |
| 62c | Lower edge of 62 |
| 63 | Third side face of 60 |
| 64 | Fourth side face of 60 |
| 65a | First recess in 61 for 54 |
| 65b | Second recess in 61 for 55 |
| 66a | First recess in 62 for 54 |
| 66b | Second recess in 62 for 55 |
| 67 | First spacer on 61 |
| 68 | Second spacer on 61 |
| 69 | Space in 11 |
| 70 | Base surface |
| 70a | Underside of 70 |
| 71 | Hole, material saving in 70 |
| 73 | First hole in 62 for 77 |
| 74 | Second hole in 62 for 77 |
| 75 | Third hole in 61 for 77, passage opening in 67 |
| 76 | Fourth hole in 61 for 77, passage opening in 68 |
| 77 | First connecting cord of 11 |
| $\alpha 1$ | First acute angle between 2.3/4.5 |
| $\alpha 2$ | Second acute angle between 6.7/8.9 |
| b11 | Width of 11 |
| b60 | Width of 60 |
| b66 | Width of 66a on 62c |
| d50 | Outside diameter of 50 |
| d57 | Outside diameter of 57 |
| d67 | Outside diameter of 67 |
| d68 | Inside diameter of 68 |
| h60 | Thickness of 60, or rather height of 61, 62, 63, 64 |
| L26 | Longitudinal axis of 26 |
| L27 | Longitudinal axis of 27 |
| L28 | Longitudinal axis of 28 |
| L29 | Longitudinal axis of 29 |
| l11 | Length 11 |
| L14 | Longitudinal axis of 14 |
| L15 | Longitudinal axis of 15 |
| L54 | Longitudinal axis of 54 |
| L55 | Longitudinal axis of 55 |
| L60 | Longitudinal axis of 60 |
| l60 | Length of 60 |
| l67 | Length of 67 |
| l68 | Length of 68 |
| U1 | Circumferential direction of 1 |
| U54 | Circumferential direction of 54 |
| V | Front view |
| H | Rear view |
| L | View from the left |
| R | View from the right |
| X | Cutout of detail in FIG. 7 for FIG. 8a |
| Y | Cutout of detail in FIG. 2b for FIG. 5 |
| Z | Cutout of detail in FIG. 3a for FIG. 4 |

The invention claimed is:

1. A portable table, comprising:

a table top and a frame, wherein the frame comprises two front legs and two rear legs, as well as two front arms and two rear arms, wherein the front legs and the rear legs have in each case a first, lower free end which is directed toward a support and a second, upper end, wherein the front arms and rear arms have in each case a second, upper end which is directed toward the table top, and a first, lower end, wherein the front legs, by way of their second, upper end which is located opposite the first, lower free end, and the front arms, by way of their first, lower end which is located opposite the second, upper end, are fastened on a first, front connecting element, wherein the rear legs, by way of their second, upper end which is located opposite the first, lower free end and the rear arms, by way of their first, lower end which is located opposite the second, upper end, are fastened on a second, rear connecting element, wherein the first, front connecting element is connected to the second, rear connecting element by means of at least one first connecting rod, wherein a first coupling element, which connects a front, left arm to a first longitudinal rod which is arranged parallel to the at least one first connecting rod, is arranged on the second, upper end of the front, left arm and in that a second coupling element, which connects a rear, left arm to the first longitudinal rod, is arranged on the second end of the rear, left arm, and wherein a third coupling element, which connects a front, right arm to a second longitudinal rod which is arranged parallel to the at least one first connecting rod, is arranged on the second end of the front, right arm, wherein a fourth coupling element, which connects a rear, right arm to the second longitudinal rod, is arranged on the second end of the rear, right arm, wherein the table top comprises at least one device by which the table top is releasably fastenable on the frame, and wherein each of the first to fourth coupling elements is formed in an angled and integral manner and comprises a first sleeve portion for receiving a front end or rear end of one of the two longitudinal rods, and comprises a second sleeve portion which is arranged at an angle to the first sleeve portion and is realized for receiving an upper end of an arm of the frame.

2. The portable table according to claim 1, wherein the table top is releasably fastenable by the at least one device on the first longitudinal rod or on the second longitudinal rod or on at least one of the first to fourth coupling elements.

3. The portable table according to claim 2, wherein the table top is releasably fastenable on the first longitudinal rod and on the second longitudinal rod.

4. The portable table according to claim 2, wherein the table top is releasably fastenable on at least two of the first to fourth coupling elements.

5. The portable table according to claim 1, wherein the table top is connectable to the frame in a positive locking and/or non-positive locking manner by means of the at least one device.

6. The portable table according to claim 1, wherein the table top is composed of individual table elements which are couplable together.

7. The portable table according to claim 6, wherein the individual table elements are identically realized.

8. The portable table according to claim 7, wherein the individual table elements comprise in each case a rectangular base surface and comprise a longitudinal axis which is arranged transversely with respect to a longitudinal axis of the at least one first connecting rod of the frame.

9. The portable table according to claim 7, wherein of the individual table elements either a frontmost table element or a rearmost table element has an orientation which comprises an orientation which has been rotated by 180 degrees in the circumferential direction of the table relative to an orientation of the table element which is arranged between the frontmost table element and the rearmost table element.

10. The portable table according to claim 6, wherein the individual table elements comprise in each case a base surface which forms a top surface of the table top, wherein the base surface is delimited by four side faces which extend substantially at right angles to the base surface.

11. The portable table according to claim 10, wherein a first side face, which extends in the longitudinal direction of the table element, and a second side face, which extends in the longitudinal direction of the table element and is located opposite the first side face, comprise in each case at least one downwardly open recess for the support of the table element on at least one longitudinal rod.

12. The portable table according to claim 11, wherein the second side face, which extends in each case in the longitudinal direction of a frontmost table element and of a rearmost table element, comprises at least one downwardly open recess for clamping the frontmost table element and the rearmost table element onto in each case at least one of the coupling elements.

13. The portable table according to claim 6, wherein a first side face of the individual table elements, which extends in the longitudinal direction of the table element, comprises in each case at least one spacer which is directed to the respective adjacent table element.

14. The portable table according to claim 13, wherein each table element comprises on the first side face two spacers which are spaced apart from one another and have different outside diameters.

15. The portable table according to claim 6 wherein the individual table elements are coupled together by means of at least one elastic cord.

16. The portable table according to claim 15, wherein the elastic cord comprises at least one end which is fastened on a frontmost table element or on a rearmost table element.

17. The portable table according to claim 6, wherein the table top is composed of individual table elements in the form of plate elements or profile elements which comprise in each case at least one open recess, which is directed toward the support, for positive locking or non-positive locking to the frame.

18. The portable table according to claim 17, wherein the at least one open recess is located on a side face of the respective table element, the at least one open recess being directed toward the support, for positive locking and or non-positive locking to the first and the second longitudinal rod.

19. The portable table according to claim 1, wherein the first longitudinal rod and the second longitudinal rod are realized in each case by two tube portions.

20. The portable table according to claim 19, wherein the first longitudinal rod and the second longitudinal rod are realized in each case by two tube portions which are interconnectable by means of a plug-in connection.

21. The portable table according to claim 1, wherein the first longitudinal rod and the second longitudinal rod are realized in each case in a tubular manner and in each case are connected by means of an elastic cord to at least one of the two front arms or to at least one of the two rear arms.

22. The portable table according to claim 1, wherein the first, front connecting element is connected by means of a first connecting rod and a second connecting rod to the second, rear connecting element.

23. The portable table according to claim 22, wherein the second connecting rod is arranged parallel to the first connecting rod.

24. The portable table according to claim 22, wherein the two connecting rods are interconnected by means of an elastic cord.

25. The portable table according to claim 1, wherein the front legs and the rear legs, as well as the front arms and the rear arms are designed in each case as tube portions, and wherein the two front legs are interconnected by means of at least one first elastic cord, wherein the two rear legs are interconnected by means of at least one second elastic cord, wherein the two front arms are interconnected by means of at least one third elastic cord, and wherein the two rear arms are interconnected by means of at least one fourth elastic cord.

26. The portable table according to claim 25, wherein the first, front connecting element and the second, rear connecting element are connected to a fifth elastic cord, wherein the first longitudinal rod is connected to the two front arms by means of the third elastic cord, and the second longitudinal rod is connected to the two rear arms by means of the fourth elastic cord.

27. The portable table according to claim 1, wherein each of the first to fourth coupling elements comprises, in a longitudinal direction of a respective longitudinal rod, an axial projection with a smaller diameter than the outside diameter of a first sleeve portion, wherein a circumferential flange, which surrounds the axial projection, on the coupling element forms a stop face for an inside surface of a second side face of the frontmost or rearmost table element of the table top, said second side face extending in the longitudinal direction of a frontmost or rearmost table element and perpendicular to a base surface of the frontmost or rearmost table element, such that the table top is stretched as a result of pulling or tensioning the frontmost or rearmost table element over at least one of the front coupling elements and at least one of the rear coupling elements, or wherein each of the first to fourth coupling elements comprises a circumferential groove, in which the second side face of the frontmost or rearmost table element is able to engage or rather can be tensioned by way of a corresponding recess, such that a position of the table top on the frame is fixed in the direction of the longitudinal axis of the longitudinal rods.

* * * * *